US010230199B2

(12) United States Patent
Tsukanaka et al.

(10) Patent No.: US 10,230,199 B2
(45) Date of Patent: Mar. 12, 2019

(54) CONTACT SWITCHING MECHANISM AND CONNECTOR

(71) Applicant: OMRON Corporation, Kyoto-shi, Kyoto (JP)

(72) Inventors: Yohei Tsukanaka, Konan (JP); Hiroyasu Masago, Ritto (JP)

(73) Assignee: OMRON Corporation, Kyoto-shi (JP)

( * ) Notice: Subject to any disclaimer, the term of this patent is extended or adjusted under 35 U.S.C. 154(b) by 0 days.

(21) Appl. No.: 15/953,533

(22) Filed: Apr. 16, 2018

(65) Prior Publication Data

US 2018/0342842 A1 Nov. 29, 2018

(30) Foreign Application Priority Data

May 29, 2017 (JP) ..... 2017-105219

(51) Int. Cl.

| | |
|---|---|
| ***H01R 13/71*** | (2006.01) |
| ***H01R 13/629*** | (2006.01) |
| ***H01R 13/70*** | (2006.01) |
| ***H01R 12/50*** | (2011.01) |
| *H01R 13/26* | (2006.01) |
| *H01R 13/05* | (2006.01) |
| *H01R 12/72* | (2011.01) |

(52) U.S. Cl.

CPC ..... *H01R 13/71* (2013.01); *H01R 13/62927* (2013.01); *H01R 13/701* (2013.01); *H01R 23/6813* (2013.01); *H01R 23/6833* (2013.01); *H01R 12/72* (2013.01); *H01R 13/05* (2013.01); *H01R 13/26* (2013.01)

(58) Field of Classification Search

CPC ..... H01R 13/71; H01R 23/6813

See application file for complete search history.

(56) References Cited

U.S. PATENT DOCUMENTS

| | | | | |
|---|---|---|---|---|
| 4,176,900 | A * | 12/1979 | Hines | H01R 12/88 439/260 |
| 4,768,971 | A * | 9/1988 | Simpson | H01R 23/6813 439/329 |
| 5,088,931 | A * | 2/1992 | Niciolo | H01R 13/7034 439/188 |
| 6,780,044 | B1 * | 8/2004 | Sawyer | H01R 4/2433 200/61.62 |
| 2002/0173189 | A1 * | 11/2002 | Koyasu | H01R 13/08 439/188 |
| 2003/0062252 | A1 * | 4/2003 | Fonseca | G06F 21/85 200/538 |
| 2005/0250376 | A1 * | 11/2005 | Ostmeier | G01R 1/0416 439/521 |
| 2007/0254520 | A1 * | 11/2007 | Niggemann | H01R 9/2491 439/395 |

FOREIGN PATENT DOCUMENTS

| | | | |
|---|---|---|---|
| JP | 2015-232987 | A | 12/2015 |

* cited by examiner

*Primary Examiner* — James Harvey

(74) *Attorney, Agent, or Firm* — Metrolexis Law Group, PLLC

(57) ABSTRACT

A contact substrate is moved to cause a connection terminal and a connection terminal to slide on the contact substrate to change the contact state of the connection terminal and the connection terminal to a first slide contact and to a second slide contact. This switches the electrical connection/disconnection between the connection terminal and the connection terminal.

12 Claims, 27 Drawing Sheets

CONTACT SWITCHING MECHANISM AND CONNECTOR

CROSS REFERENCE TO RELATED APPLICATIONS

This application claims priority from prior Japanese Patent Application No. 2017-105219 filed with the Japan Patent Office on May 29, 2017, the entire contents of which are incorporated herein by reference.

FIELD

The disclosure relates to a contact switching mechanism that switches the electrical connection/disconnection between two connection terminal sets each including multiple connection terminals.

BACKGROUND

In the medical field, ultrasonic diagnostic systems using ultrasonic waves are widely used. A typical ultrasonic diagnostic system includes an ultrasonic probe (sensor), which transmits and receives ultrasonic waves, and a system body.

The ultrasonic diagnostic system transmits an ultrasonic wave generated by a transducer included in the ultrasonic probe to a target for diagnosis, and receives a reflected wave with the ultrasonic probe. The system electrically processes the received signal in the system body to generate an ultrasonic image.

The ultrasonic diagnostic system includes a connector unit for connecting the system body and a connector included in the ultrasonic probe (counterpart connector) to transmit the received signal from the ultrasonic probe to the system body. For example, Patent Literature 1 describes a connector unit for connecting a system body and an ultrasonic probe. The connector unit described in Patent Literature 1 is driven by a motor (externally driven) to connect a plug connector to a receptacle connector. This reduces effort in connecting the plug connector to the receptacle connector.

CITATION LIST

Patent Literature

Patent Literature 1: Japanese Unexamined Patent Application Publication No. 2015-232987 (published on Dec. 24, 2015)

SUMMARY

Technical Problem

The connector unit described in Patent Literature 1 is driven by the motor for moving contact pins in the receptacle connector to connect the plug connector to the receptacle connector. The connector unit described in Patent Literature 1 uses a mechanism for moving the contact pins. The mechanism may complicate the structure.

One or more aspects are directed to a simplified contact switching mechanism that switches the electrical connection/disconnection between connection terminal sets.

Solution to Problem

A contact switching mechanism according to one aspect includes a plurality of connection terminal sets, an insulating substrate including a conductive slide contact, and a substrate drive that moves the substrate. The substrate drive moves the substrate to cause the connection terminal sets to slide on the substrate to change a contact state between the slide contact and the connection terminal sets and to switch the electrical connection/disconnection between the connection terminal sets.

This structure switches the electrical connection/disconnection between the connection terminal sets by moving the substrate. This structure switches the electrical connection/disconnection simply by moving the substrate without moving the connection terminal sets that may be difficult to move. The simple structure without, for example, additional moving contacts, can switch the electrical connection/disconnection between the connection terminal sets.

In the contact switching mechanism according to another aspect, the plurality of connection terminal sets include at least one first connection terminal and at least one second connection terminal, and the substrate drive moves the substrate to switch electrical connection/disconnection between the at least one first connection terminal and the at least one second connection terminal.

In the contact switching mechanism according to another aspect, the slide contact is located on a straight line including a point of contact between the at least one first connection terminal and the substrate, and a point of contact between the at least one second connection terminal facing the at least one first connection terminal and the substrate, and the substrate drive moves the substrate in a direction parallel to the straight line to switch electrical connection/disconnection between the at least one first connection terminal and the at least one second connection terminal.

This structure switches the electrical connection/disconnection between the first connection terminal and the second connection terminal facing each other by moving the substrate in one direction.

In the contact switching mechanism according to another aspect, the slide contact includes a first slide contact and a second slide contact having different lengths along the straight line, and the at least one first connection terminal and the at least one second connection terminal corresponding to the first slide contact are electrically connected to each other when the substrate is at a first position, and the at least one first connection terminal and the at least one second connection terminal corresponding to the second slide contact are electrically connected to each other when the substrate is at a second position different from the first position.

This structure switches the electrical connection/disconnection between the first connection terminal and the second connection terminal corresponding to the first slide contact and switches the electrical connection/disconnection between the first connection terminal and the second connection terminal corresponding to the second slide contact in a stepwise manner by moving the substrate to the different positions.

In the contact switching mechanism according to another aspect, the first connection terminal and the second connection terminal corresponding to the first slide contact are electrically connected to each other irrespective of the position of the substrate.

This structure switches the electrical connection/disconnection between the first connection terminal and the second connection terminal corresponding to the second slide contact, while the first connection terminal and the second connection terminal corresponding to the first slide contact are electrically connected constantly to each other.

In the contact switching mechanism according to another aspect, a first slide contact corresponding to the at least one first connection terminal, and a second slide contact corresponding to the at least one second connection terminal to be electrically connected to or disconnected from the at least one first connection terminal are not located on a straight line parallel to a moving direction of the substrate, and the first slide contact and the second slide contact are electrically connected to each other in an area different from sliding areas of the first connection terminal and the second connection terminal.

This structure switches the electrical connection/disconnection between a first connection terminal and a second connection terminal not facing each other in electrically connecting between a first connection terminal set and a second connection terminal set including at least one first connection terminal and at least one second connection terminal facing each other.

A connector for electrically connecting to a connection target according to another aspect includes the contact switching mechanism according to any one of the above aspects. The plurality of connection terminal sets include a first connection terminal set including a plurality of first connection terminals and a second connection terminal set including a plurality of second connection terminals. The first connection terminal set corresponds to a plurality of target terminals included in the connection target. The substrate drive moves the substrate to switch the electrical connection/disconnection between the first connection terminal set and the second connection terminal set.

Advantageous Effects

The system according to one or more aspect includes fewer components.

DETAILED DESCRIPTION

A connector unit 10 (connector) and a contact switching mechanism according to a first embodiment will now be described in detail.

The structure of the connector unit 10 according to one or more embodiments will now be described with reference to FIGS. 1 to 12B.

Figure 1:
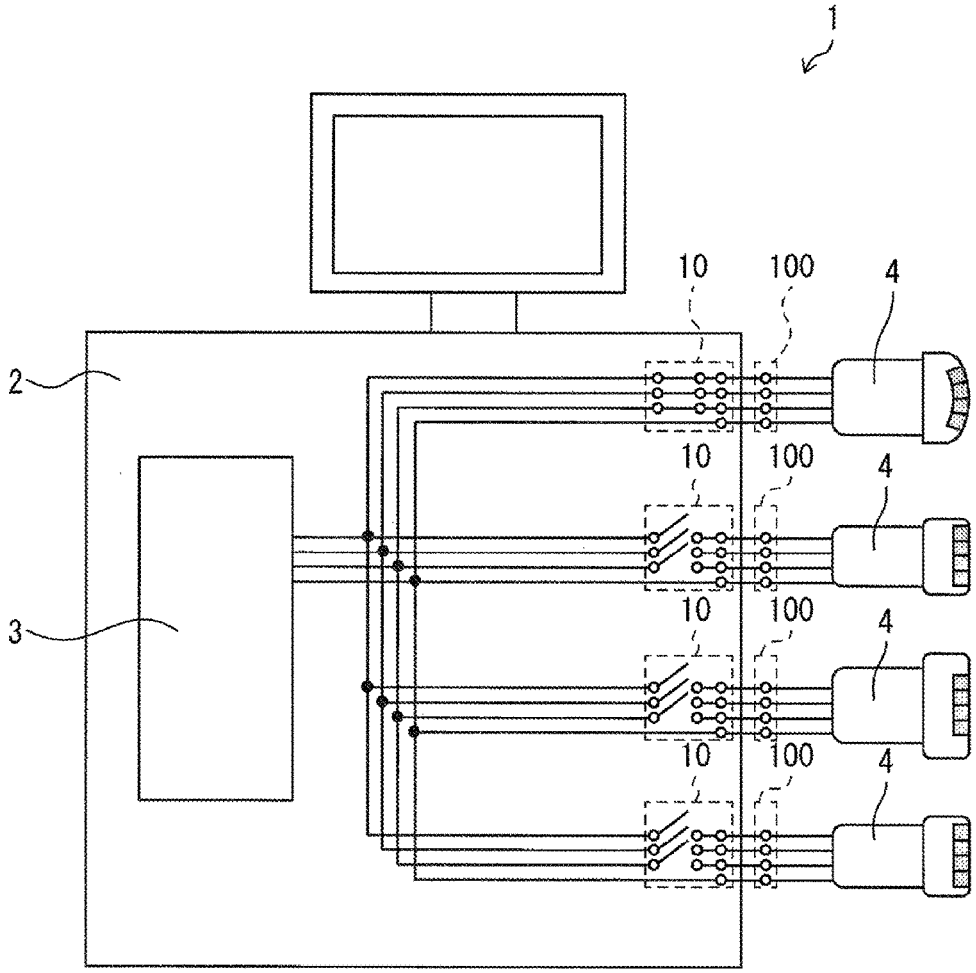
FIG. 1 is a schematic diagram illustrating an ultrasonic diagnostic system including a connector unit according to a first embodiment.
Figure 2:
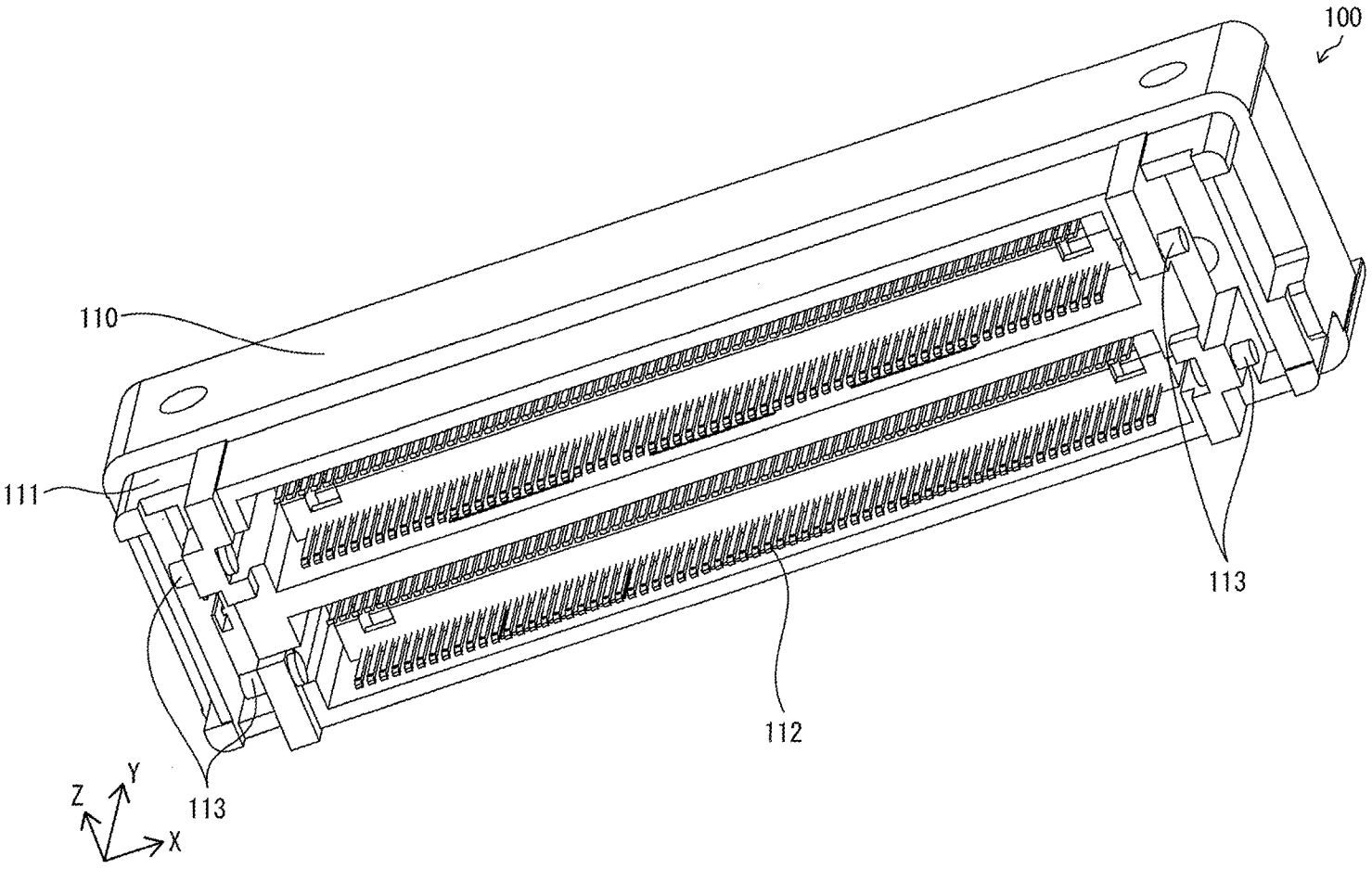
FIG. 2 is an external perspective view illustrating a probe connector included in an ultrasonic diagnostic system with the probe connector viewed from below.

FIG. 1 is a schematic diagram of an ultrasonic diagnostic system 1 including connector units 10. For ease of explanation, the positive X direction in FIG. 2 is the forward direction, the negative X direction is the rearward direction, the positive Y direction is the upward direction, the negative Y direction is the downward direction, the positive Z direction is the rightward direction, and the negative Z direction is the leftward direction.

As shown in FIG. 1, the ultrasonic diagnostic system 1 includes a substrate 2, a control circuit 3 mounted on the substrate 2, four ultrasonic probes 4, four connector units 10 arranged on the substrate 2 and electrically connected to the control circuit 3, and probe connectors (connection targets) 100 connected to the corresponding ultrasonic probes 4.

Probe Connector 100

Each probe connector 100 to be connected to the corresponding connector unit 10 will now be described with reference to FIG. 2.

FIG. 2 is an external perspective view of the probe connector 100 viewed from below. As shown in FIG. 2, the probe connector 100 includes a housing 110, a fitting portion 111, multiple connection terminals (target terminals) 112, and protrusions (engagement receivers) 113.

The multiple connection terminals 112 are used for power supply and the transmission of an electrical signal obtained in the ultrasonic probe 4 and ID information about the ultrasonic probe 4. The connection terminals 112 are arranged in four rows in the front-and-rear direction and held by a holding member (not shown). The housing 110 and the fitting portion 111 internally support the holding member to hold the connection terminals 112. The lower parts of the connection terminals 112 are exposed outside.

The fitting portion 111 is a part of the probe connector 100 to be fitted into the connector unit 10. The distance between the right and left sides of the fitting portion 111 is shorter than the distance between the right and left sides of the housing 110. Thus, when the probe connector 100 is fitted into the connector unit 10, the bottom surface of the housing 110 comes into contact with the top surface of a housing 21 described later, and the fitting portion 111 is contained in the housing 21.

The front and rear sides of the fitting portion 111 each include two columnar protrusions 113 that extend outward.

Structure of Connector Unit 10

The structure of the connector unit 10 will now be described with reference to FIGS. 3 to 12B.

Figure 3:
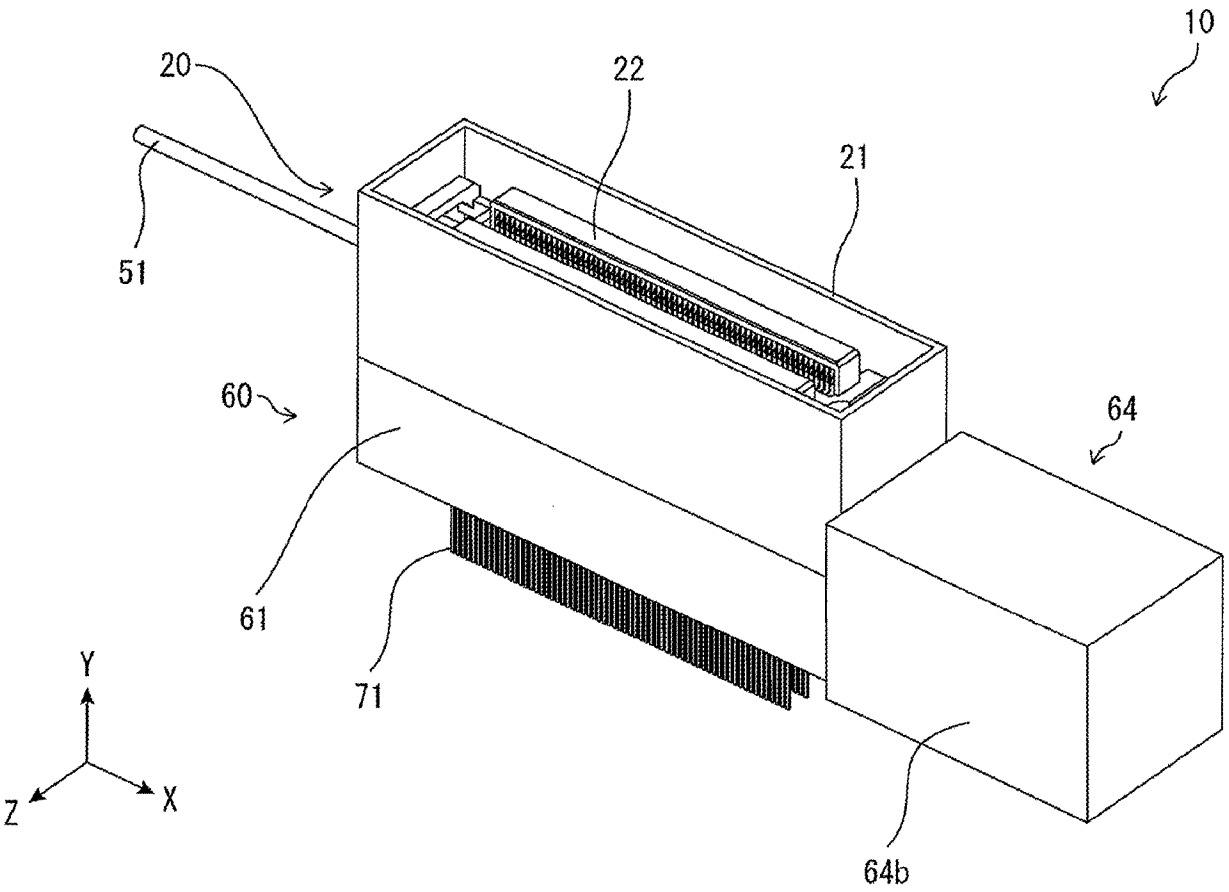
FIG. 3 is a perspective view illustrating a connector unit showing its structure.
Figure 4:
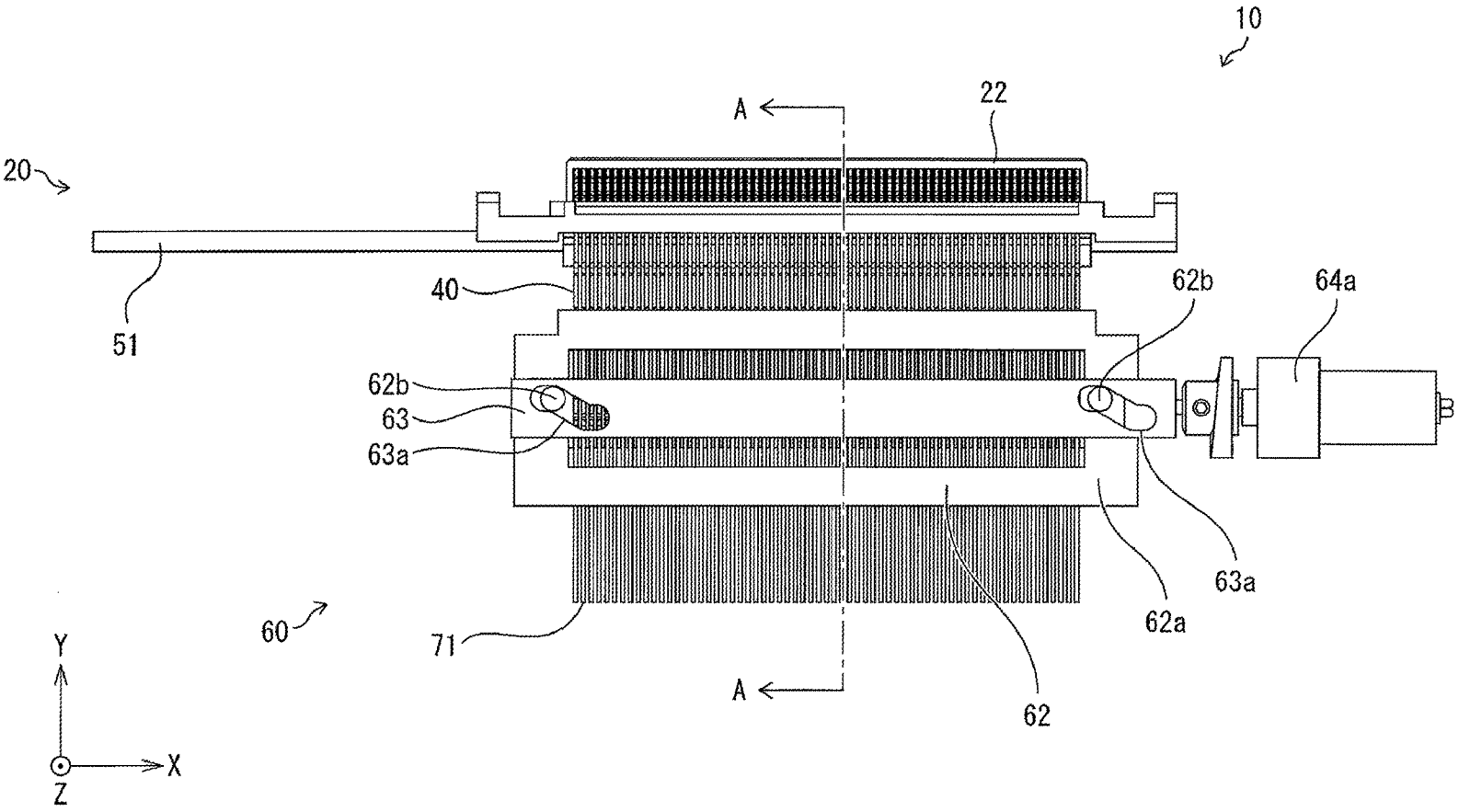
FIG. 4 is a side view illustrating a connector unit.
Figure 5:
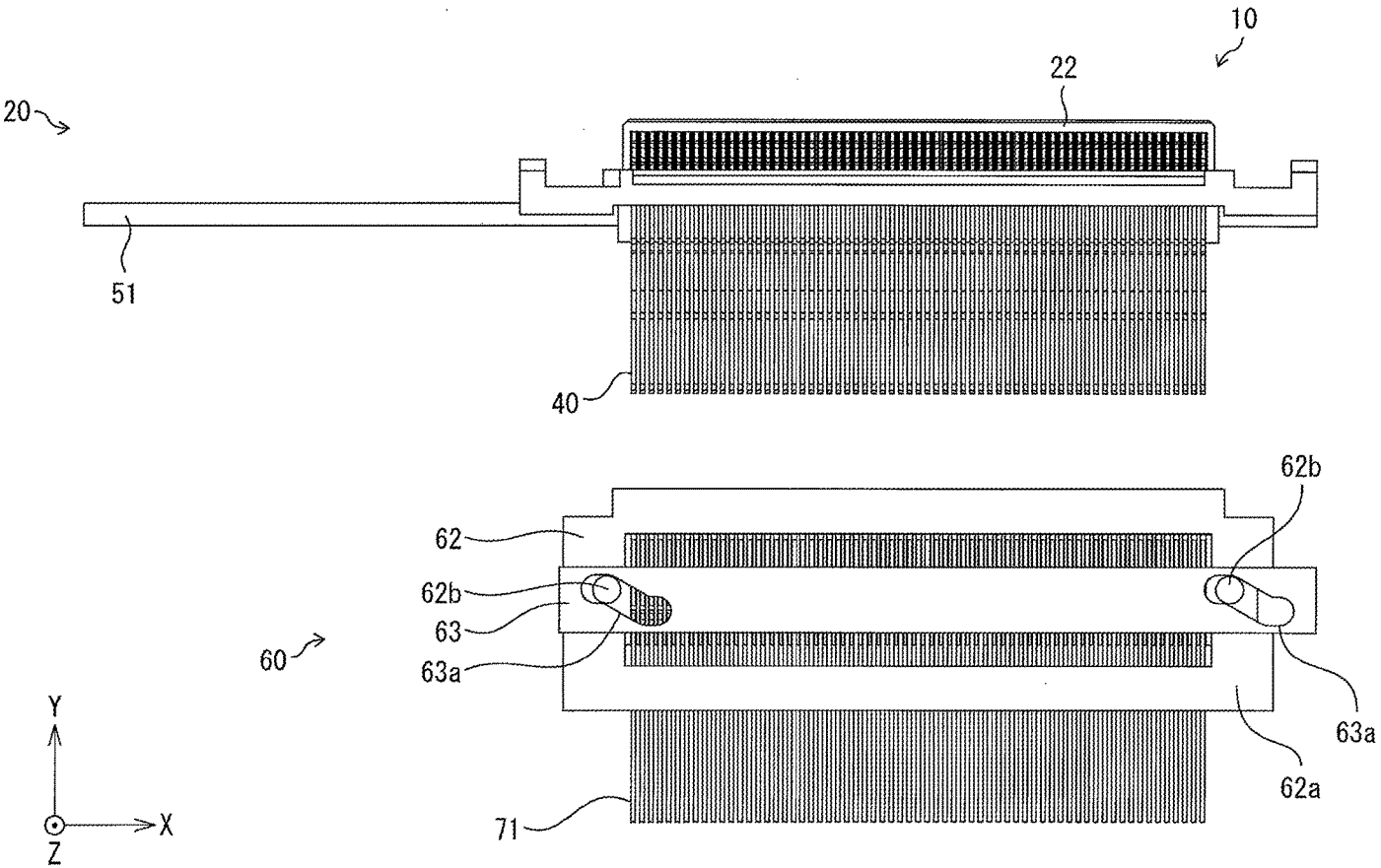
FIG. 5 is a side view illustrating a connector unit separated into a first contact on-off unit that is an upper part and a second contact on-off unit that is a lower part.
Figure 6:
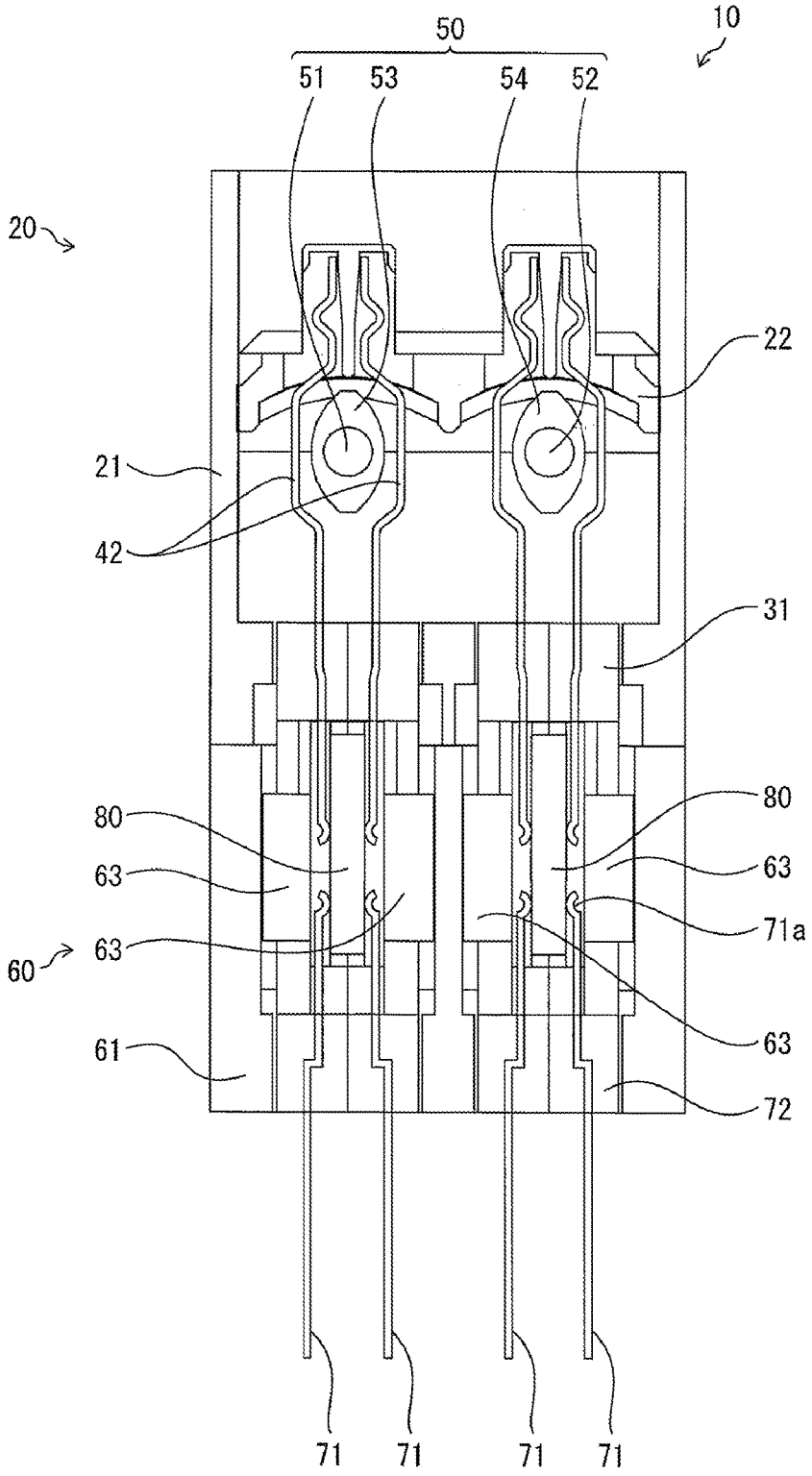
FIG. 6 is a diagram illustrating cross-sectional view taken in the arrow direction of line A-A in FIG. 4.

FIG. 3 is a perspective view of the connector unit 10 showing its structure. FIG. 4 is a side view of the connector unit 10. FIG. 5 is a side view of the connector unit 10 separated into a first contact on-off unit 20 that is an upper part and a second contact on-off unit 60 that is a lower part. FIG. 6 is a cross-sectional view taken in the arrow direction of line A-A in FIG. 4. In FIGS. 4 and 5, the housing 21 included in the first contact on-off unit 20, a housing 61 included in the second contact on-off unit 60, and a motor box 64*b* (described later) are not shown. In FIG. 5, a motor unit 64 is also not shown.

As shown in FIGS. 4 to 6, the connector unit 10 includes the first contact on-off unit 20 and the second contact on-off unit 60.

First Contact On-Off Unit 20

The first contact on-off unit 20 allows electrical connection between the substrate 2 and the ultrasonic probe 4 when the probe connector 100 is inserted in the connector unit 10. The first contact on-off unit 20 electrically connects or disconnects selected terminals (stationary terminals). The first contact on-off unit 20 will be described with reference to FIGS. 3 to 8.

As shown in FIGS. 3 to 5, the first contact on-off unit 20 includes the housing 21, two terminal units 30, a socket housing 22, and a switch mechanism 50.

The housing 21 contains each component of the first contact on-off unit 20. The top of the housing 21 is open to receive the probe connector 100. The housing 21 has two openings (not shown) in the bottom surface.

Figure 7A:
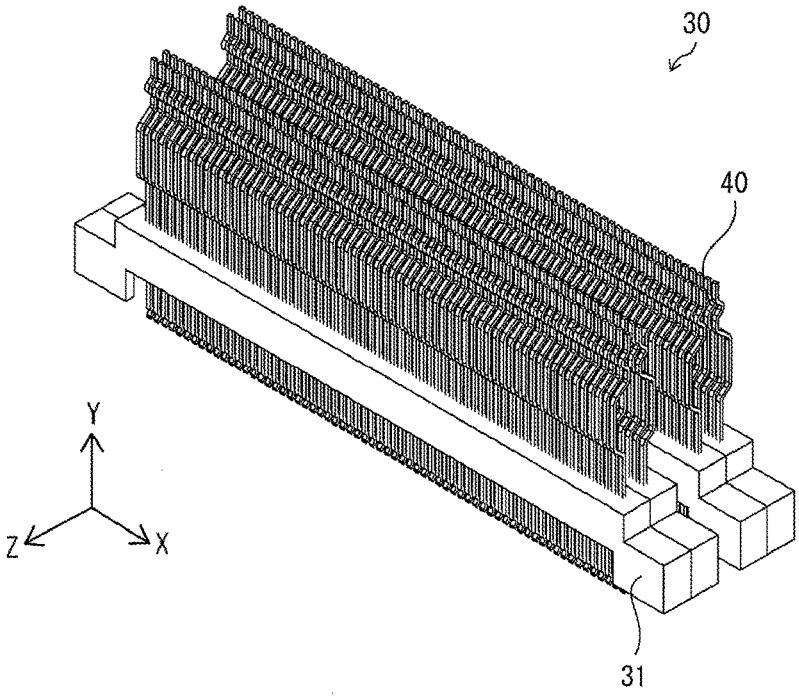
FIG. 7A is a perspective view illustrating terminal units included in a first contact on-off unit.
Figure 7B:
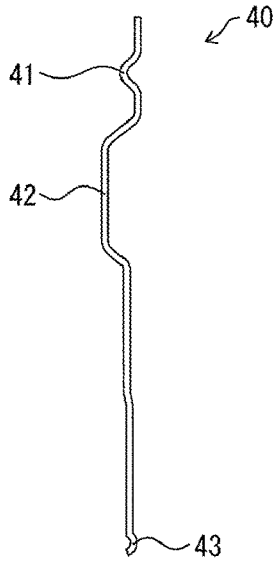
FIG. 7B is a plan view illustrating one connection terminal included in a terminal unit.

FIGS. 7A and 7B show the structure of the terminal units 30. FIG. 7A is a perspective view of the terminal units 30, and FIG. 7B is a plan view showing the structure of a connection terminal 40 included in a terminal unit 30. As shown in FIG. 7A, each terminal unit 30 includes multiple connection terminals (first connection terminals) 40 corresponding to the connection terminals 112 in the probe connector 100, and a holding member 31.

As shown in FIG. 7B, each connection terminal 40 is an elongated metal plate extending in one direction (vertical direction). The connection terminal 40 has a first curve 41, a second curve 42, and a third curve 43 that are formed by bending the metal plate. The first curve 41 is located near the upper end of the connection terminal 40. The second curve 42 is located near the vertical center of the connection terminal 40. The first curve 41 and the second curve 42 bend in the same direction. The third curve 43 is located near the lower end of the connection terminal 40. The third curve 43 bends in the direction opposite to the bends of the first curve 41 and the second curve 42.

As shown in FIG. 7A, the multiple connection terminals 40 are held by each holding member 31 and arranged in two rows in the front-and-rear direction. The connection terminals 40 in each row are held by the holding member 31 with the first curves 41 and the second curves 42 bending outward.

As shown in FIG. 6, the two terminal units 30 are fixed to the housing 21 by fitting each holding member 31 into the corresponding opening in the bottom surface of the housing 21. As a result, the multiple connection terminals 40 are arranged in four rows in X-direction. Each connection terminal 40 faces the corresponding connection terminal 112 in the probe connector 100 when the probe connector 100 is fit into the connector unit 10. As shown in FIG. 7A, the lower end of each connection terminal 40 protrudes downward from the holding member 31, and the third curve 43 is in contact with a slide contact 82 (a first slide contact 82*a* or a second slide contact 82*b*) on a contact substrate 80 described later (refer to FIG. 11).

Figure 8:
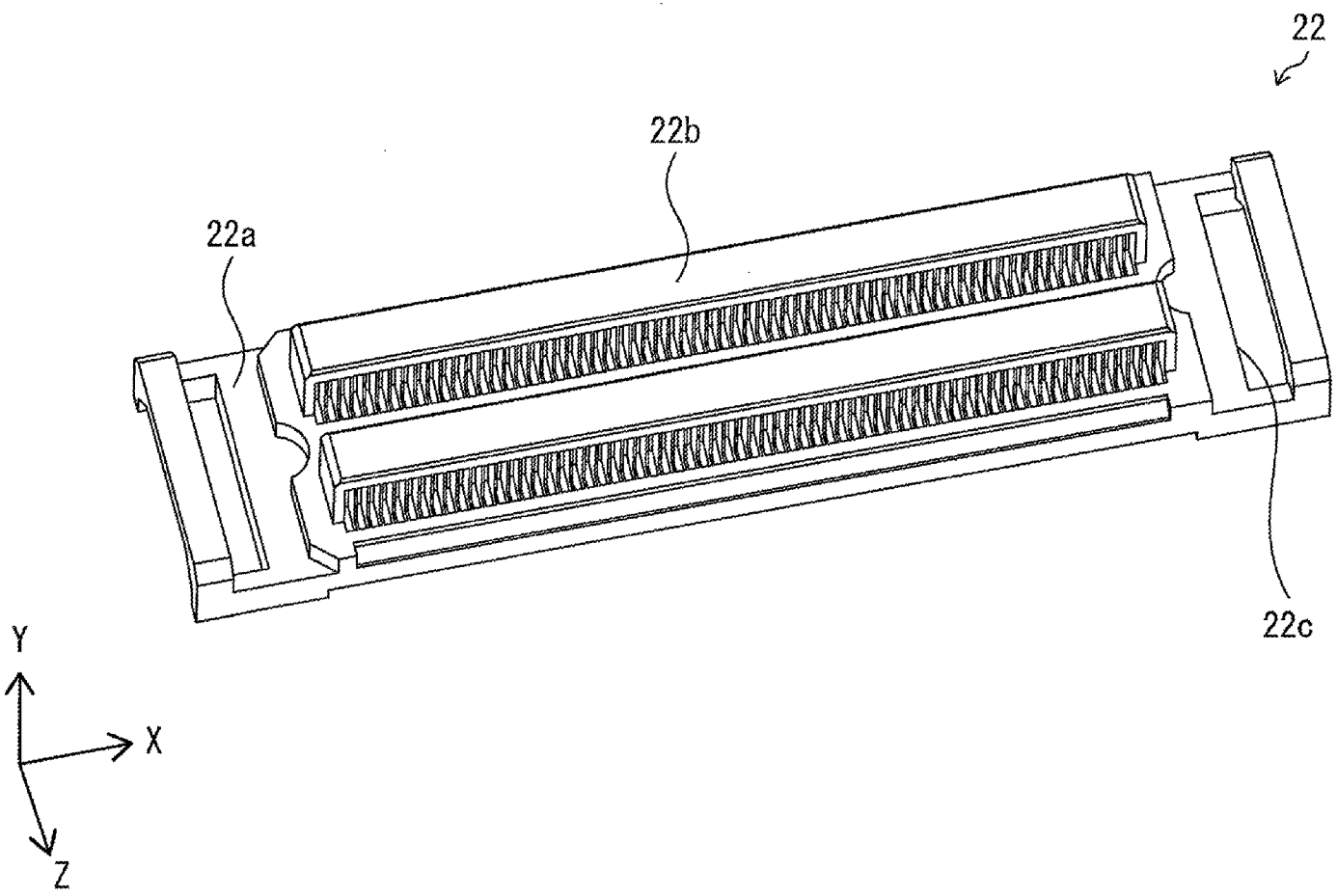
FIG. 8 is a perspective view illustrating a socket housing included in a first contact on-off unit.

FIG. 8 is a perspective view of the socket housing 22. As shown in FIG. 3, the socket housing 22 is an upper member of the first contact on-off unit 20. As shown in FIG. 8, the socket housing 22 includes a substantially rectangular, plate-like base 22*a* and two covers 22*b*.

The covers 22*b* extend upward from the top surface of the base 22*a* and cover the connection terminals 40. The covers 22*b* each have openings for the connection terminals 40 in sides parallel to the XY plane.

The switch mechanism 50 connects the connection terminals 40 in the terminal units 30 to the connection terminals 112 in the probe connector 100. As shown in FIG. 6, the switch mechanism 50 includes a first shaft (cam shaft) 51, a second shaft (cam shaft) 52, a first cam (cam) 53, and a second cam (cam) 54.

The first shaft 51 and the second shaft 52 are rods extending linearly in the front-and-rear direction (X-direction). The first shaft 51 has the front end contained in the housing 21 and the rear end extending through and protruding from the housing 21. The first shaft 51 includes an operation lever (not shown) for receiving user operations at its protrusion from the housing 21. The second shaft 52 is contained in the housing 21.

The first shaft 51 and the second shaft 52 are each supported by the housing 21 in a manner to rotate about the longitudinal axis (X-axis). The first shaft 51 and the second shaft 52 have gears (not shown) meshing each other. When the first shaft 51 rotates as the user operates the operation lever, the second shaft 52 rotates in a direction opposite to the rotational direction of the first shaft 51.

The first shaft 51 and the second shaft 52 respectively have the first cam 53 and the second cam 54 fixed in the areas corresponding to the connection terminals 40 in the terminal units 30.

As shown in FIG. 6, the first cam 53 and the second cam 54 each extend between the second curves 42 of the connection terminals 40 that face each other. The first cam 53 and the second cam 54 rotate respectively about the first shaft 51 and the second shaft 52 in cooperation with the rotation of the first shaft 51 and the second shaft 52. The first cam 53 and the second cam 54 have substantially elliptical cross sections perpendicular to the X-axis. The first cam 53 and the second cam 54 have minor axes in cross section perpendicular to the X-axis with a length smaller than the distance between the second curves 42 facing each other. The first cam 53 and the second cam 54 also have major axes in cross section perpendicular to the X-axis with a length greater than the distance between the second curves 42 facing each other. This structure allows the first cam 53 and the second cam 54 to press the connection terminals 40 outward at their second curves 42 when the cams rotate from a position shown in FIG. 6 (refer to FIG. 15A). This places the first curves 41 into contact with the connection terminals 112 in the probe connector 100.

The first shaft 51 and the second shaft 52 have locking members (not shown) near the front and rear ends of the shafts contained in the housing 21. The locking members engage with the protrusions 113 on the probe connector 100 when the first shaft 51 and the second shaft 52 rotate to have the major axes of the first cam 53 and the second cam 54 in the horizontal direction. In this manner, when the first shaft 51 and the second shaft 52 rotate to have the major axes of the first cam 53 and the second cam 54 in the horizontal direction, the physical connection of the probe connector 100 to the connector unit 10 is locked (fixed). The locking members extend through openings 22*c* and 22*d* (refer to FIG. 8) in the front and rear ends of the base 22*a* in the socket housing 22 to engage with the protrusions 113 on the probe connector 100.

Second Contact On-Off Unit 60

Figure 9:
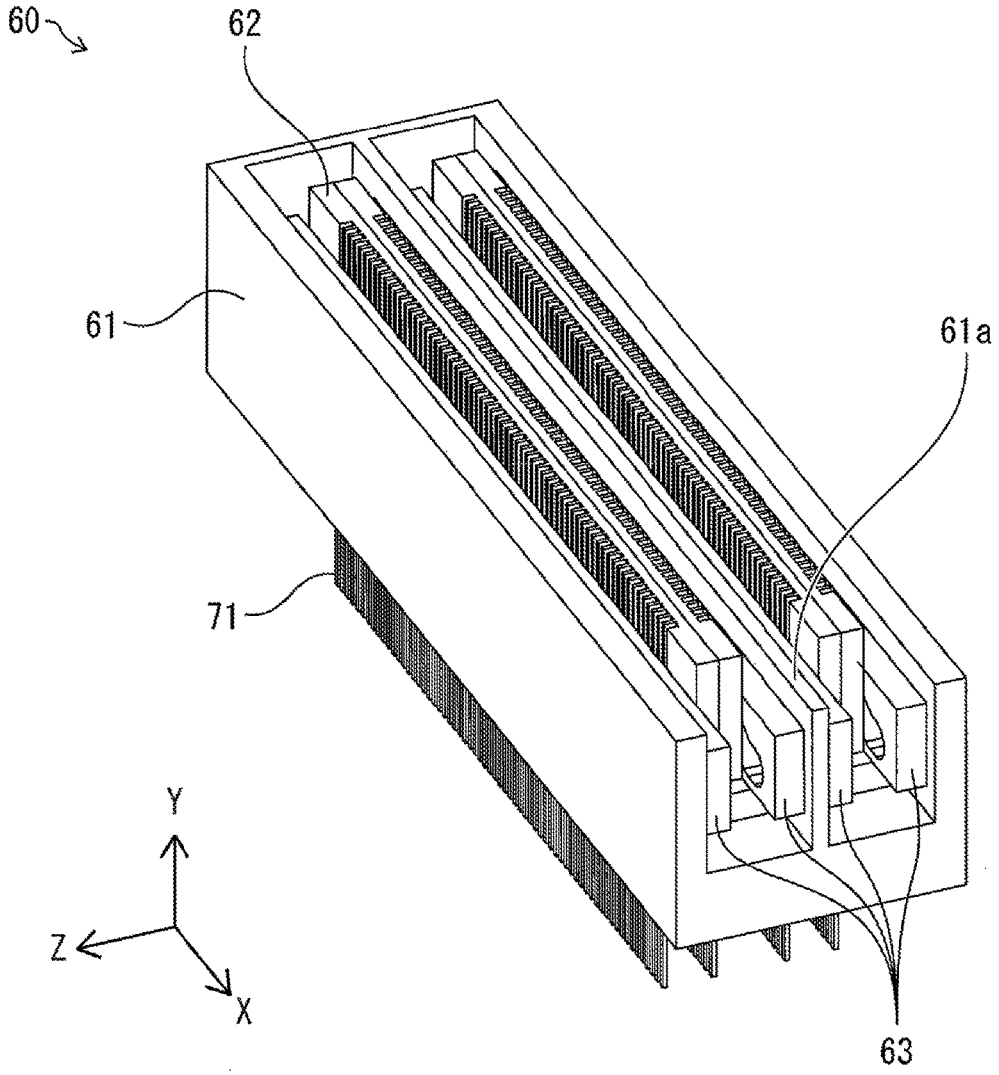
FIG. 9 is a perspective view illustrating a second contact on-off unit.

The second contact on-off unit 60 electrically connects or disconnects the connection terminals 40 in the first contact on-off unit 20 to or from the substrate 2 when the connection terminals 40 in the first contact on-off unit 20 are connected to the connection terminals 112 in the probe connector 100. The second contact on-off unit 60 electrically connects or disconnects the terminals other than the stationary terminals described above. The second contact on-off unit 60 will now be described with reference to FIGS. 3 to 6 and FIGS. 9 to 12B. FIG. 9 is a perspective view of the second contact on-off unit 60. The motor unit 64 (described later) is not shown in FIG. 9.

As shown in FIGS. 3 to 6 and 9, the second contact on-off unit 60 includes the housing 61, two terminal units 70, two contact substrates (substrates) 80, two substrate holders 62, four guide rails 63, and the motor unit 64 (substrate drive).

The housing 61 contains each component of the second contact on-off unit 60. As shown in FIG. 9, the top and the front of the housing 61 are open. Although not shown, the bottom of the housing 61 is also open. The housing 61 includes a partition 61*a* extending in the front-and-rear direction. The partition 61*a* divides the interior of the housing 61 into two right and left compartments. Each of the two compartments contains one terminal unit 70, one contact substrate 80, one substrate holder 62, and two guide rails 63.

Figure 10:
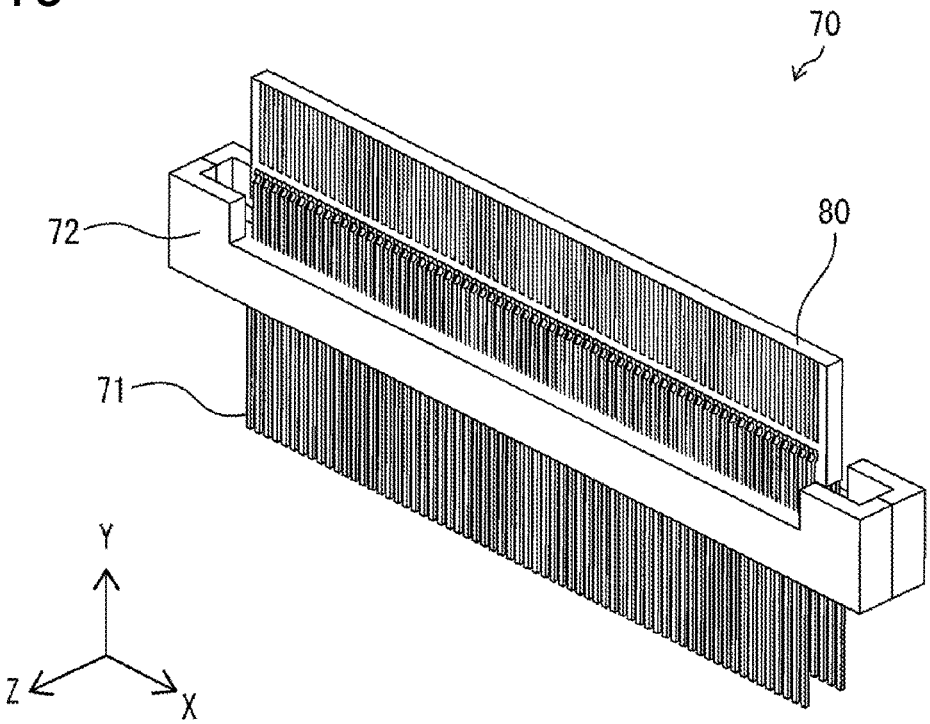
FIG. 10 is a perspective view illustrating a terminal unit and a contact substrate included in a second contact on-off unit.

FIG. 10 is a perspective view of a terminal unit 70 and a contact substrate 80. As shown in FIG. 10, the terminal unit 70 includes multiple connection terminals (second connection terminals) 71 and a holding member 72.

Each connection terminal 71 is an elongated metal plate extending in one direction (vertical direction). The connection terminal 71 has a curve 71*a* formed by bending the metal plate near its upper end (refer to FIG. 6).

The multiple connection terminals 71 are arranged in two rows in the front-and-rear direction and held by the holding member 72. As shown in FIG. 6, the connection terminals 71 are held by the holding member 72 with the curves 71*a* in contact with the contact substrate 80.

The two terminal units 70 are fixed to the housing 61 by fitting each holding member 72 in the corresponding opening in the bottom surface of the housing 61. As a result, the multiple connection terminals 71 are arranged in four rows in X-direction. Each connection terminal 71 faces the corresponding connection terminal 40 in the first contact on-off unit 20. The lower end of each connection terminal 71 protrudes downward from the holding member 72 and is connected to the substrate 2.

Figure 11:
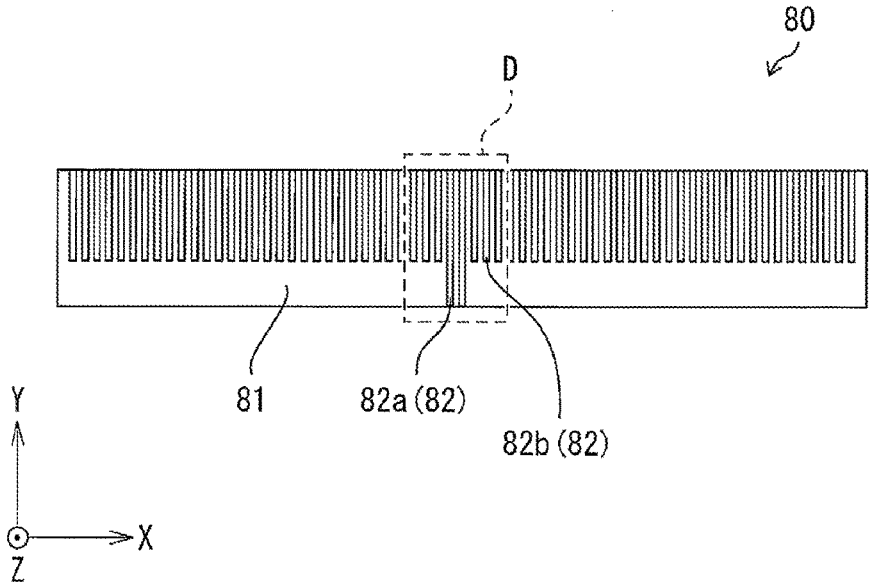
FIG. 11 is a plan view illustrating a contact substrate.

FIG. 11 is a plan view of the contact substrate 80. The contact substrate 80 allows electrical connection between the connection terminals 71 and the connection terminals 40 in the first contact on-off unit 20. As shown in FIG. 11, the contact substrate 80 is largely an insulating part 81, and includes the slide contacts 82 formed from metal on the right and left sides of the insulating part 81. The slide contacts 82 extend vertically to face the connection terminals 71 and the connection terminals 40. The slide contacts 82 are the first slide contacts 82*a* or the second slide contacts 82*b*.

The first slide contacts 82*a* allow electrical connection between the connection terminals 40 (normally-closed connection terminals) and the connection terminals 71 corresponding to connection terminals 112 that are electrically connected constantly to the substrate 2. The first slide contacts 82*a* extend from the upper end to the lower end of the contact substrate 80.

The second slide contacts 82*b* allow electrical connection between the connection terminals 40 and 71 corresponding to connection terminals 112 that are electrically connected to the substrate 2 when the ultrasonic probe 4 is used for a diagnosis. The second slide contacts 82*b* extend from the upper end to near the vertical center of the contact substrate 80.

The substrate holder 62, the guide rails 63, and a motor 64*a* function as a moving unit for moving the contact substrate 80 vertically.

The substrate holder 62 holds the contact substrate 80. The substrate holder 62 moves vertically in cooperation with the movement of the guide rails 63 (described later), and correspondingly the contact substrate 80 moves vertically. A mechanism for moving the contact substrate 80 will be described later.

The substrate holder 62 is cuboid and has an inner space for containing the contact substrate 80. The substrate holder 62 has vertical slits in right and left sides 62*a* at the positions corresponding to the slide contacts 82 on the contact substrate 80. Through the slits, the slide contacts 82 on the contact substrate 80 are exposed from the substrate holder 62.

The substrate holder 62 also has protrusions 62*b* (described later), which are located near both the front and rear ends of each side 62*a*. The protrusions 62*b* are to be inserted into openings 63*a* in the guide rails 63.

The guide rails 63 are moved by the motor 64*a* in the front-and-rear direction. Each guide rail 63 is cuboid and has the openings 63*a* near both its front and rear ends. Each opening 63*a* extends downward obliquely toward the motor 64*a* (in the forward direction, or the positive X-direction). As described above, the openings 63*a* receive the protrusions 62*b* on the substrate holder 62.

As shown in FIGS. 3 and 4, the motor unit 64 includes the motor 64*a* and the motor box 64*b* containing the motor 64*a*. The motor 64*a* is a drive for moving the guide rails 63 in the front-and-rear direction. The guide rails 63 may be moved by the motor 64*a* using any known method, and thus the movement will not be described in detail. The drive of the motor 64*a* is controlled using an electrical signal from the control circuit 3.

Mechanism for Moving Contact Substrate 80

A mechanism for moving the contact substrate 80 vertically will now be described with reference to FIGS. 12A and 12B.

Figure 12A:
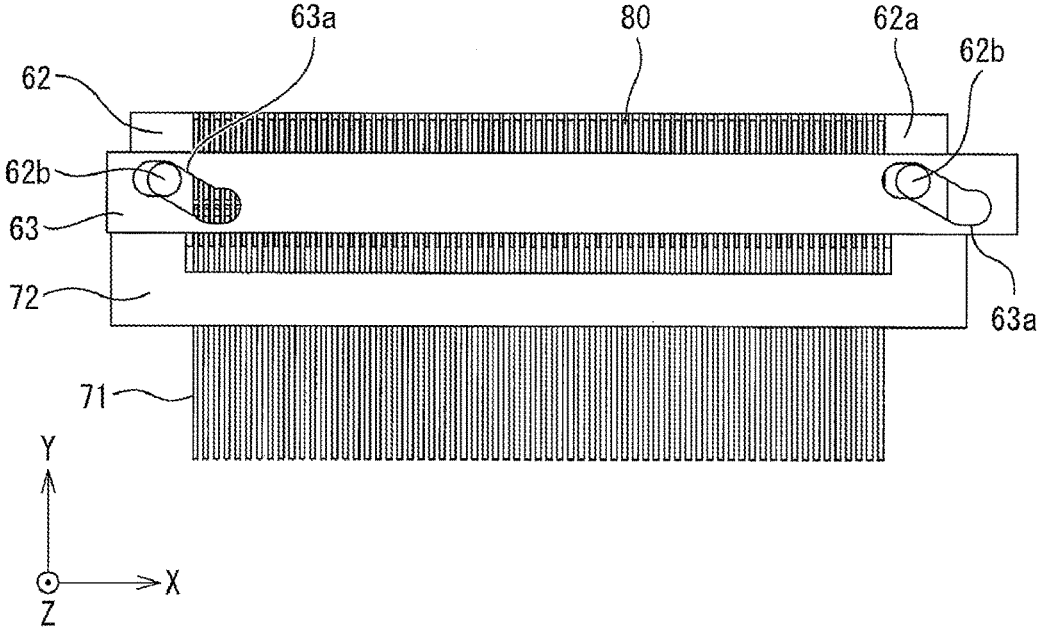
FIGS. 12A and 12B are diagrams illustrating a mechanism for moving a contact substrate vertically, with the contact substrate at an upper position in FIG. 12A and the contact substrate at a lower position in FIG. 12B.
Figure 12B:
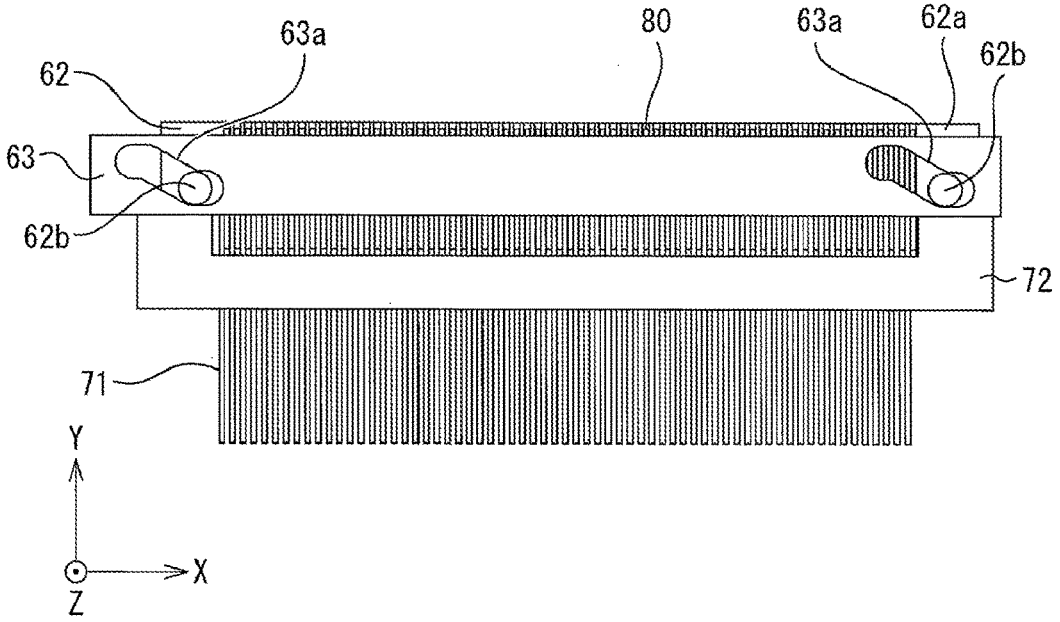

FIGS. 12A and 12B show the mechanism for moving the contact substrate 80 vertically. FIG. 12A is a diagram showing the contact substrate 80 at the upper position, and FIG. 12B is a diagram showing the contact substrate 80 at the lower position.

As shown in FIG. 12A, when the guide rails 63 are positioned nearer the motor 64*a* (the front, or the positive X-direction), each protrusion 62*b* on the substrate holder 62 is positioned at the rear (or the negative X-direction) of the corresponding opening 63*a* in the guide rail 63. In this state, the protrusion 62*b* is supported on the lower periphery of the opening 63*a* in the negative X-direction, and the contact substrate 80 is set at the upper position. In this state, the motor 64*a* drives (actuator driving) the guide rails 63 to move rearward (in the negative X-direction). As the guide rails 63 move, each protrusion 62*b* on the substrate holder 62 receives a downward force applied from the upper periphery of the opening 63*a* in the guide rail 63. This moves the substrate holder 62 downward. As the substrate holder 62 moves, the contact substrate 80 moves downward. As shown in FIG. 8B, the moved protrusion 62*b* is supported on the lower periphery of the opening 63*a* in the positive X-direction, and the contact substrate 80 is set at the lower position.

Operation of Connector Unit 10

The operation of the connector unit 10 will now be described with reference to FIGS. 13A to 16B. An operation for electrically connecting the connection terminals 112 of the probe connector 100 to the substrate 2 will be described first.

Figure 13A:
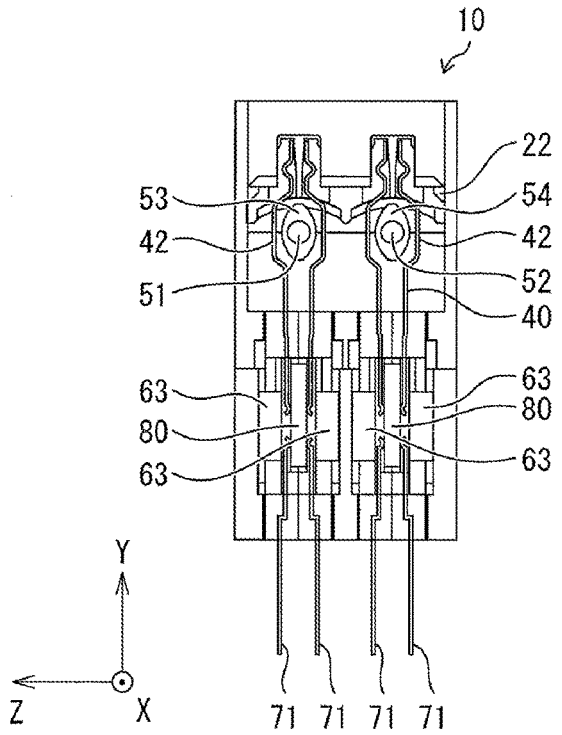
FIG. 13A is a cross-sectional view illustrating a connector unit with no probe connector inserted.
Figure 13B:
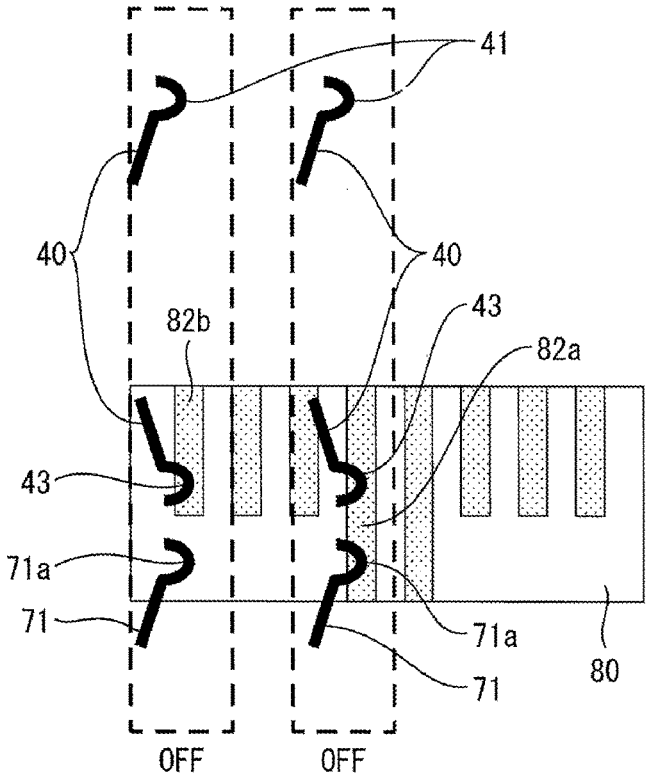
FIG. 13B is a schematic diagram illustrating the connection of connection terminals in first and second contact on-off units to a contact substrate.

FIGS. 13A and 13B show the state with no probe connector 100 inserted in the connector unit 10. FIG. 13A is a cross-sectional view of the connector unit 10, and FIG. 13B is a schematic diagram showing the connection of the connection terminals 40 and 71 to the contact substrate 80. For ease of explanation, the connection terminals 40 and 71 shown in FIG. 13B are rotated by 90 degrees about the vertical axis. The figure shows only the connection terminals 40 and 71 corresponding to one first slide contact 82*a* and one second slide contact 82*b*. FIG. 13B shows only a part of the contact substrate 80 corresponding to area D in FIG. 11. The subsequent drawings (FIGS. 14B, 15B, and 16B) also show the terminals and the substrate in the same manner. Hereafter, the conductive path including the connection terminal 112, the connection terminal 40, and the connection terminal 71 corresponding to the first slide contact 82*a* is referred to as a first line (the right one of the areas drawn with a dashed line in FIG. 13B), whereas the conductive path including the connection terminal 112, the connection terminal 40, and the connection terminal 71 corresponding to the second slide contact 82*b* is referred to as a second line (the left one of the areas drawn with the dashed line in FIG. 13B).

As shown in FIG. 13A, the connector unit 10 without the probe connector 100 inserted includes the first cam 53 and the second cam 54 having the major axes in the vertical direction. In this state, the connection terminals 40 are not in contact with the first cam 53 and the second cam 54. In this state, as shown in FIG. 13B, the third curves 43 of the connection terminals 40 are in contact with the slide contacts 82 on the contact substrate 80. The curve 71*a* of the connection terminal 71 in the first line is in contact with the first slide contact 82*a*, whereas the curve 71*a* of the connection terminal 71 in the second line is not in contact with the second slide contact 82*b*.

Figure 14A:
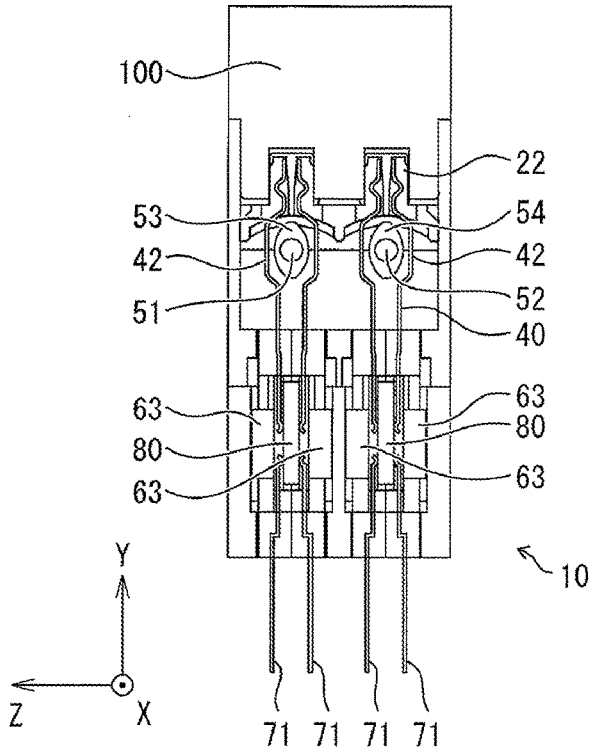
FIG. 14A is a cross-sectional view illustrating a connector unit with a probe connector inserted.
Figure 14B:
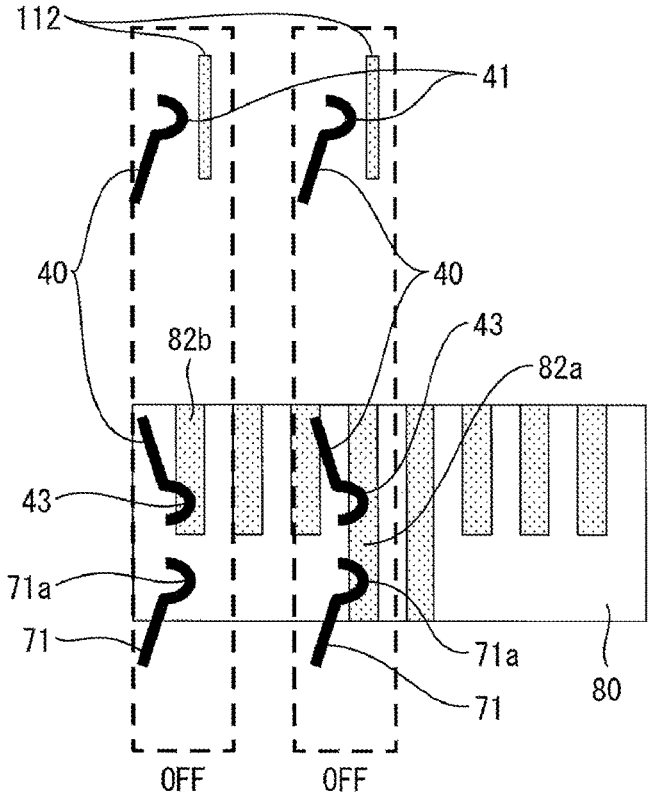
FIG. 14B is a schematic diagram illustrating the connection of connection terminals in first and second contact on-off units to a contact substrate, and to connection terminals included in a probe connector.

FIGS. 14A and 14B show the connector unit 10 with the probe connector 100 inserted. FIG. 14A is a cross-sectional view of the connector unit 10 and the probe connector 100, and FIG. 14B is a schematic diagram showing the connection of the connection terminals 40 and 71 to the contact substrate 80, and to the connection terminals 112.

When the probe connector 100 is inserted in the connector unit 10 as shown in FIGS. 14A and 14B, the connection terminals 112 face the first curves 41 of the connection terminals 40. However, the connection terminals 112 are not in contact with the first curves 41 of the connection terminals 40 in this state, and none of the first line and second line is electrically conducting.

Figure 15A:
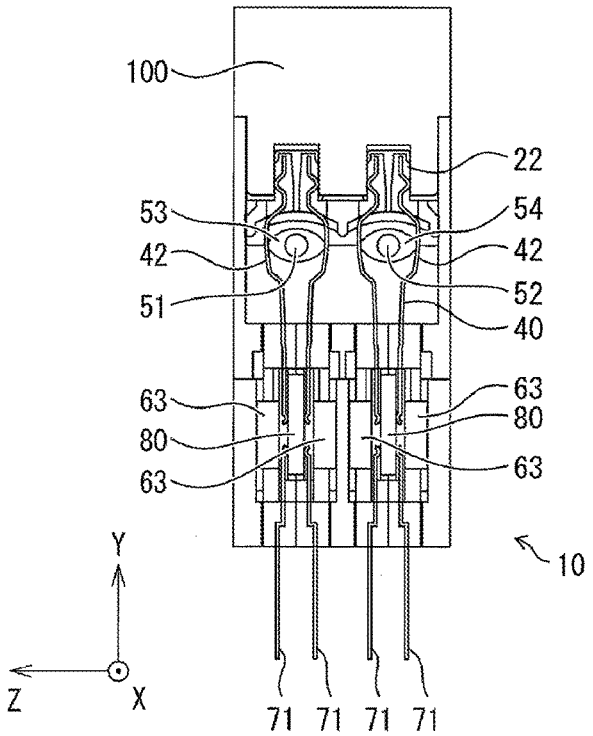
FIG. 15A is a cross-sectional view illustrating a probe connector and a connector unit with its first and second shafts rotated to have major axes of first and second cams in a horizontal direction.
Figure 15B:
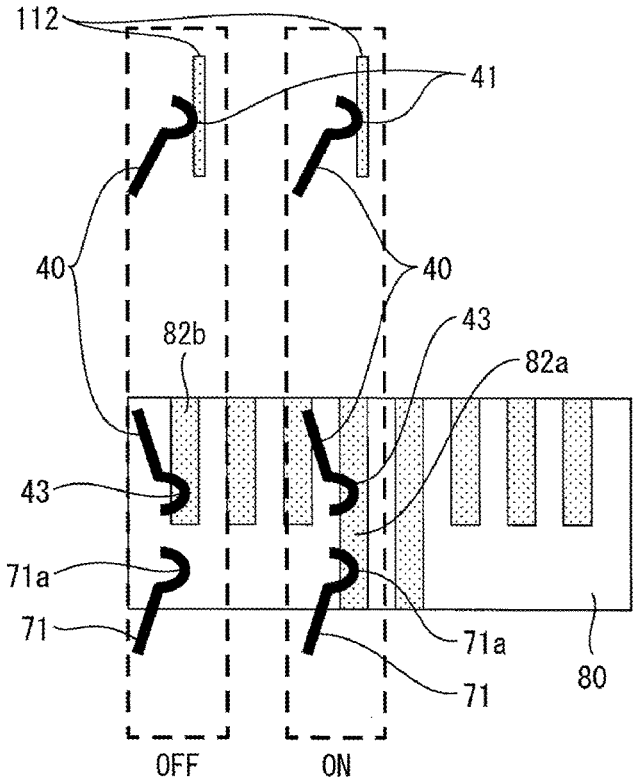
FIG. 15B is a schematic diagram showing the connection of connection terminals in first and second contact on-off units to a contact substrate, and to connection terminals included in a probe connector.

FIGS. 15A and 15B show the connector unit 10 with the first shaft 51 and the second shaft 52 rotated to have the major axes of the first cam 53 and the second cam 54 in the horizontal direction. FIG. 15A is a cross-sectional view of the connector unit 10 and the probe connector 100, and FIG. 15B is a schematic diagram showing the connection of the connection terminals 40 and 71 to the contact substrate 80, and to the connection terminals 112.

In the state shown in FIGS. 14A and 14B, when the user operates the operation lever to rotate the first shaft 51, the first shaft 51 and the second shaft 52 each rotate as shown in FIG. 15A. In cooperation with the rotation, the first cam 53 and the second cam 54 rotate until the major axes are in the horizontal direction. The rotated first and second cams 53 and 54 press the connection terminals 40 outward at their second curves 42. This places the first curves 41 into contact with the connection terminals 112 in the probe connector 100.

For the first line shown in FIG. 15B, the first curve 41 of the connection terminal 40 is in contact with the connection terminal 112, the third curve 43 of the connection terminal 40 is in contact with the first slide contact 82*a*, and the curve 71*a* of the connection terminal 71 is in contact with the first slide contact 82*a*. As a result, the connection terminal 112 in the probe connector 100 corresponding to the first line is electrically connected to the substrate 2. In contrast, the curve 71*a* of the connection terminal 71 in the second line is not in contact with the second slide contact 82*b*, and thus the connection terminal 112 in the probe connector 100 corresponding to the second line is not electrically connected to the substrate 2.

Figure 16A:
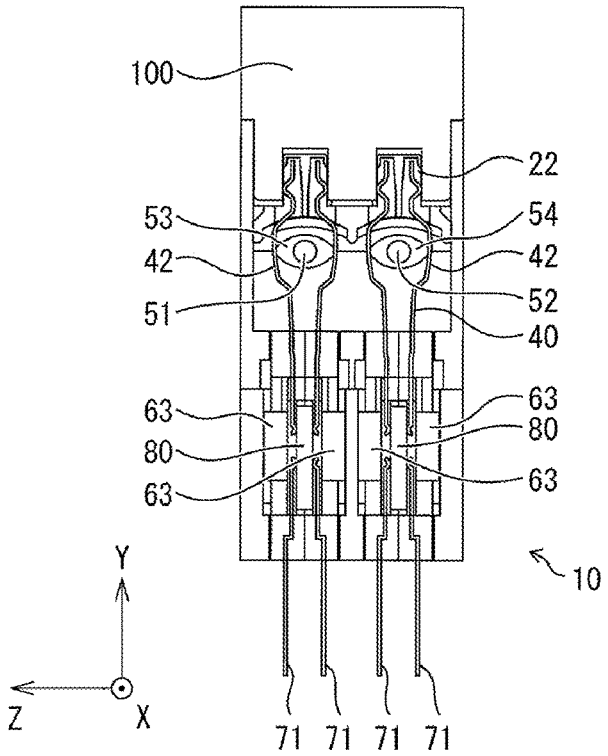
FIG. 16A is a cross-sectional view illustrating a connector unit and a probe connector with a contact substrate moved downward.
Figure 16B:
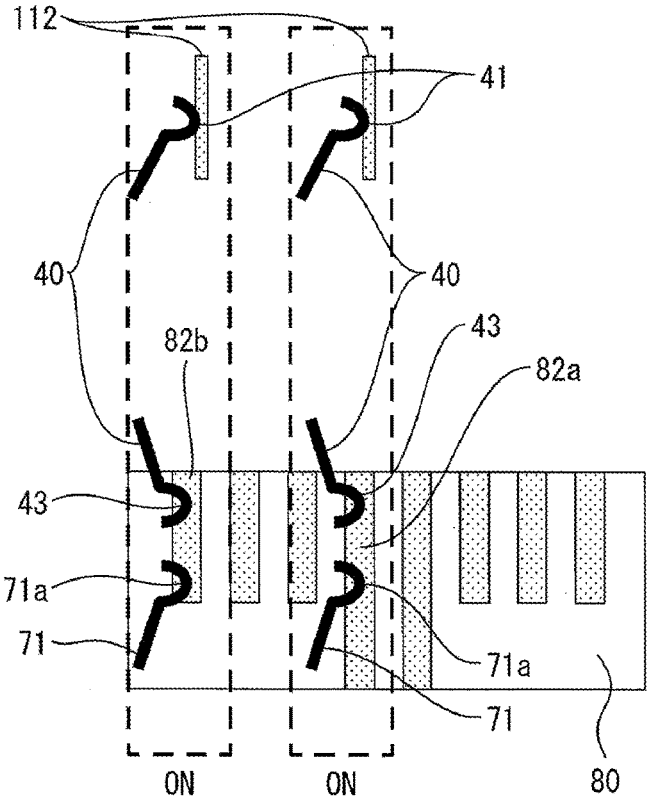
FIG. 16B is a schematic diagram showing the connection of connection terminals in first and second contact on-off units to a contact substrate, and to connection terminals included in a probe connector.

FIGS. 16A and 16B show the connector unit 10 with the contact substrate 80 moved downward. FIG. 16A is a cross-sectional view of the connector unit 10 and the probe connector 100, and FIG. 16B is a schematic diagram showing the connection of the connection terminals 40 and 71 to the contact substrate 80, and to the connection terminals 112.

As shown in FIG. 16A, the contact substrate 80 is then moved downward by the motor 64*a*. The moving mechanism has been described above. As shown in FIG. 16B, this places the curve 71*a* of the connection terminal 71 in the second line into contact with the second slide contact 82*b*. In the second line, the first curve 41 of the connection terminal 40 is thus in contact with the connection terminal 112, the third curve 43 of the connection terminal 40 is in contact with the second slide contact 82*b*, and the curve 71*a* of the connection terminal 71 is in contact with the second slide contact 82*b*. As a result, the connection terminal 112 in the probe connector 100 corresponding to the second line is electrically connected to the substrate 2. In the state shown in FIGS. 16A and 16B as well, the curve 71*a* of the connection terminal 71 corresponding to the first line is in contact with the first slide contact 82*a*, and thus the connection terminal 112 in the probe connector 100 corresponding to the first line is electrically connected to the substrate 2. More specifically, in the state shown in FIGS. 16A and 16B, all the connection terminals 112 in the probe connector 100 are electrically connected to the substrate 2.

An operation for electrically disconnecting the connection terminals 112 of the probe connector 100 from the substrate 2 will now be described. In the state shown in FIGS. 16A and 16B, the motor 64*a* moves the contact substrate 80 upward. As shown in FIGS. 15A and 15B, the curve 71*a* of the connection terminal 71 in the second line then comes out of contact with the second slide contact 82*b*. As a result, the connection terminal 112 in the probe connector 100 corresponding to the second line is electrically disconnected from the substrate 2. However, in this state, the connection terminal 112 in the probe connector 100 corresponding to the first line is electrically connected to the substrate 2.

The user then operates the operation lever to rotate the first shaft 51 and the second shaft 52 until the major axes of the first cam 53 and the second cam 54 are in the vertical direction. The first and second cams 53 and 54 then stop pressing the second curves 42 of the connection terminals 40. The first curves 41 thus come out of contact with the corresponding connection terminals 112 in the probe connector 100 as shown in FIGS. 14A and 14B. As a result, all the connection terminals 112 in the probe connector 100 are electrically disconnected from the substrate 2. This allows the probe connector 100 to be removed from the connector unit 10.

As described above, the contact switching mechanism in the second contact on-off unit 60 includes a first connection terminal set including the multiple connection terminals 40, a second connection terminal set including the multiple connection terminals 71, the insulating contact substrate 80 having the conductive slide contacts 82 (the first slide contacts 82*a* and the second slide contacts 82*b*), and the motor 64*a* for moving the contact substrate 80. The motor 64*a* moves the contact substrate 80 to slide the connection terminals 40 and the connection terminals 71 on the contact substrate 80. This changes the contact state of the connection terminals 40 and 71 to the slide contacts 82, and thus switches the electrical connection/disconnection between the connection terminals 40 and 71.

This contact switching mechanism moves the contact substrate 80 to switch the electrical connection/disconnection between the first connection terminal set including the multiple connection terminals 40 and the second connection terminal set including the multiple connection terminals 71. The connection terminals 40 are connected to the connection terminals 112 in the probe connector 100, and the connection terminals 71 are connected to wires that are to be electrically connected to the probe connector 100 (wires connected to the substrate 2) via the connector unit 10. The connection terminals 40 and 71 are thus typically difficult to move. The contact switching mechanism switches the electrical connection/disconnection by moving the contact substrate 80 without moving the connection terminals 40 and 71. Thus, the simple structure without, for example, additional moving contacts, can switch the electrical connection/disconnection between the first connection terminal set and the second connection terminal set.

In the contact switching mechanism in the second contact on-off unit 60, each slide contact 82 is located on a straight line including a contact point of the corresponding connection terminal 40 to the contact substrate 80, and a contact point of the connection terminal 71 facing the connection terminal 40 to the contact substrate 80. The motor 64*a* moves the contact substrate 80 in a direction parallel to the straight line to switch the electrical connection/disconnection between the first connection terminal set and the second connection terminal set.

This contact switching mechanism moves the contact substrate 80 in one direction to switch electrical connection/disconnection between the connection terminals 40 and the connection terminals 71 facing each other.

In the contact switching mechanism in the second contact on-off unit 60, the connection terminal 40 and the connection terminal 71 each corresponding to the first slide contact 82*a* (or in the first line) are electrically connected to each other irrespective of the position of the contact substrate 80.

In this contact switching mechanism with the first contact on-off unit 20 closed and the second contact on-off unit 60 open, the connection terminal 112 and the connection terminal 71 corresponding to the first line are electrically connected to each other. With the first contact on-off unit 20 closed and the second contact on-off unit 60 closed, all the connection terminals 112 and the corresponding connection terminals 71 are electrically connected to each other. In other words, when the first contact on-off unit 20 is closed, selected connection terminals 112 in the probe connector 100 and the substrate 2 are constantly electrically connected to each other irrespective of whether the second contact on-off unit 60 is open or closed. For example, connection terminals to be connected to the probe connector 100 to constantly obtain information (e.g., a connection terminal for obtaining the ID of the ultrasonic probe 4 and a connection terminal for supplying power to the ultrasonic probe 4) may be electrically connected constantly, and the other connection terminals may be switched for electrical connection as appropriate.

The connection terminals to be constantly connected may be changed by changing the wiring pattern on the contact substrate 80 (in other words, setting the slide contacts 82 either as first slide contacts 82*a* or as second slide contacts 82*b*). This structure costs less for changing the connection terminals to be constantly connected than when, for example, the arrangement or the shapes of the connection terminals are to be changed.

Although the connector unit in an embodiment is included in an ultrasonic diagnostic system, a connector unit according to one or more embodiments may have other uses. For example, the connector unit may be used for any electronic device including multiple sensors.

First Modification

A contact switching mechanism in the second contact on-off unit 60 according to a modification of a first embodiment will now be described with reference to FIGS. 17A and 17B. For ease of explanation, the components having the same functions as the components described in a first embodiment are given the same reference numerals as those components, and will not be described.

Figure 17A:
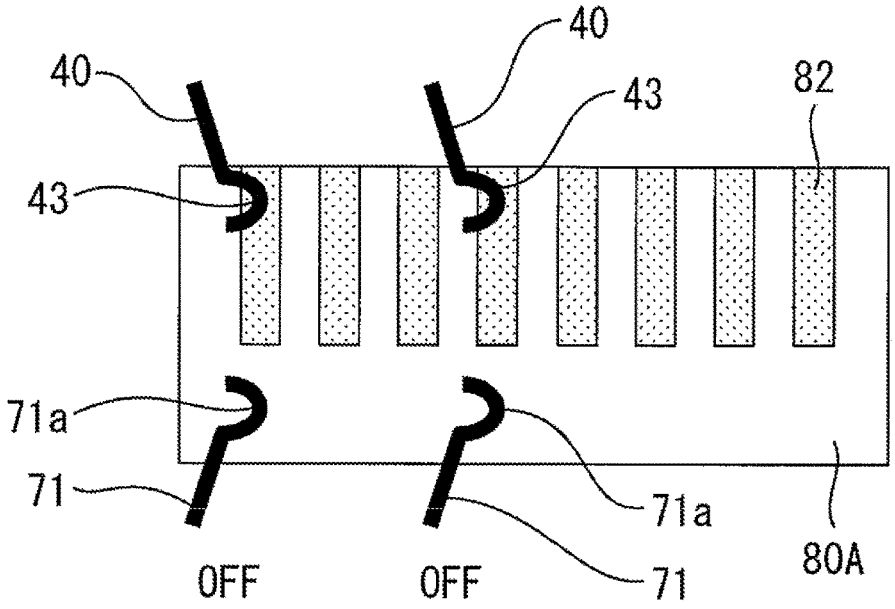
FIGS. 17A and 17B are diagrams illustrating the switching of the electrical connection/disconnection between connection terminals in a first contact on-off unit and connection terminals in second contact on-off units on a contact substrate according to a modification of a first embodiment.
Figure 17B:
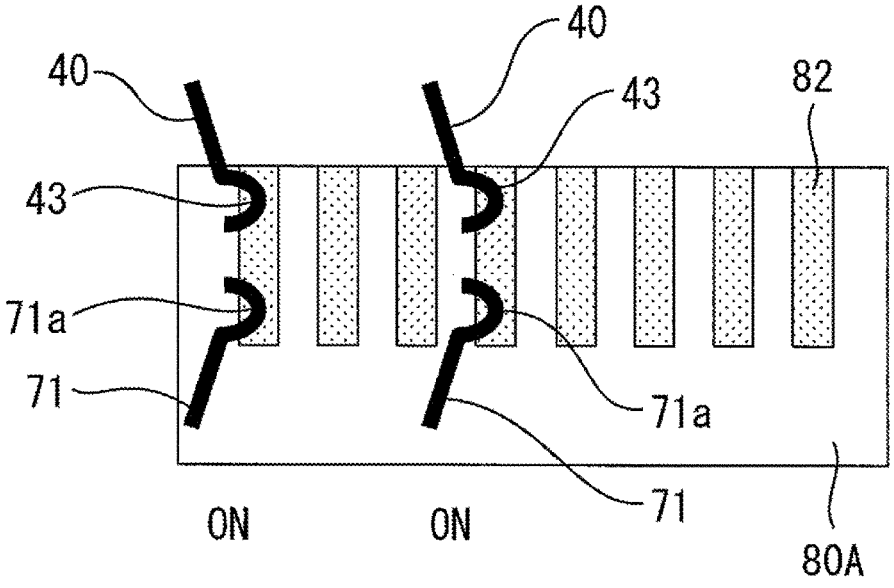

FIGS. 17A and 17B show the switching of the electrical connection/disconnection between the connection terminals 40 and 71 on a contact substrate 80A as a modification of the contact substrate 80 included in the second contact on-off unit 60 in a first embodiment. FIGS. 17A and 17B show a part of the contact substrate 80A (the same applies to FIGS. 18A to 21B below).

As shown in FIGS. 17A and 17B, the contact substrate 80A in the present modification has slide contacts 82 extending vertically and facing the connection terminals 71 and the connection terminals 40. All the slide contacts 82 have the same vertical length.

In the contact switching mechanism in the second contact on-off unit 60 according to the present modification, when the contact substrate 80A is set at the upper position, the curves 71*a* of all the connection terminals 71 are out of contact with the slide contacts 82 as shown in FIG. 17A. In other words, all the connection terminals 40 are electrically disconnected from all the connection terminals 71.

When the motor 64*a* moves the contact substrate 80A downward as shown in FIG. 17B, the curves 71*a* of all the connection terminals 71 come into contact with the slide contacts 82, and the third curves 43 of all the connection terminals 40 are also in contact with the slide contacts 82. As a result, all the connection terminals 40 are electrically connected with all the connection terminals 71.

In this manner, the contact switching mechanism in the second contact on-off unit 60 according to the present modification switches the electrical connection/disconnection between all the connection terminals 40 and the connection terminals 71 by driving the motor 64*a* to move the contact substrate 80A.

Second Modification

A contact switching mechanism in the second contact on-off unit 60 according to another modification of a first embodiment will now be described with reference to FIGS. 18A to 18D.

FIGS. 18A to 18D show the switching of the electrical connection/disconnection between the connection terminals 40 and 71 on a contact substrate 80B as a modification of the contact substrate 80 included in the second contact on-off unit 60 in a first embodiment.

As shown in FIGS. 18A to 18D, the contact substrate 80B in the present modification has first slide contacts 82*a*, second slide contacts 82*b*, and third slide contacts 82*c*, which serve as the slide contacts 82.

The first slide contact 82*a*, the second slide contact 82*b*, and the third slide contact 82*c* have different vertical lengths. More specifically, the first slide contact 82*a*, the second slide contact 82*b*, and the third slide contact 82*c* have upper ends aligned with the top of the contact substrate 80B, whereas the first slide contact 82*a*, the second slide contact 82*b*, and the third slide contact 82*c* have lower ends at different levels. The lower end of the second slide contact 82*b* is positioned below the lower end of the first slide contact 82*a*, and the lower end of the third slide contact 82*c* is positioned below the lower end of the second slide contact 82*b*.

Figure 18A:
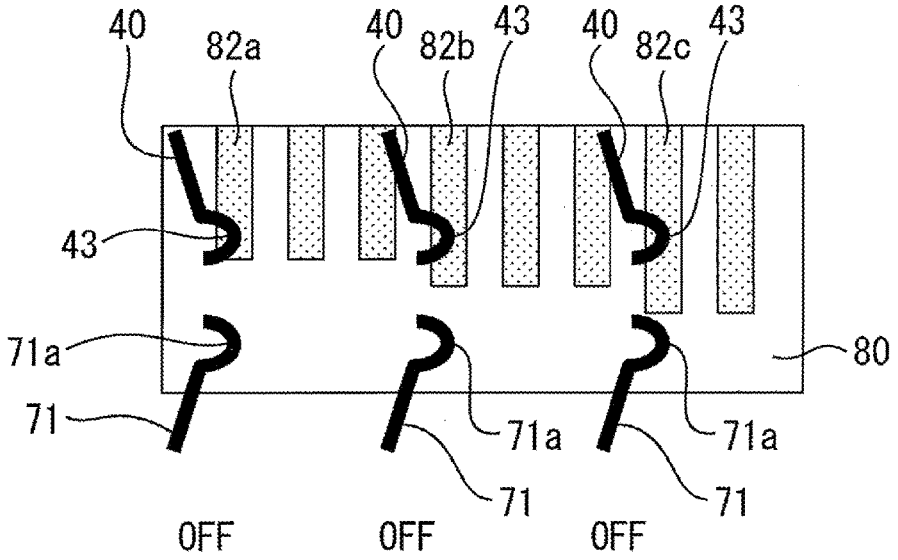
FIGS. 18A to 18D are diagrams illustrating the switching of the electrical connection/disconnection between connection terminals in a first contact on-off unit and connection terminals in second contact on-off units on a contact substrate according to another modification of a first embodiment.

In the contact switching mechanism in the second contact on-off unit 60 according to the present modification, when the contact substrate 80B is set at the upper position, the curves 71*a* of all the connection terminals 71 are out of contact with the slide contacts 82 as shown in FIG. 18A. More specifically, all the connection terminals 40 are electrically disconnected from all the connection terminals 71.

Figure 18B:
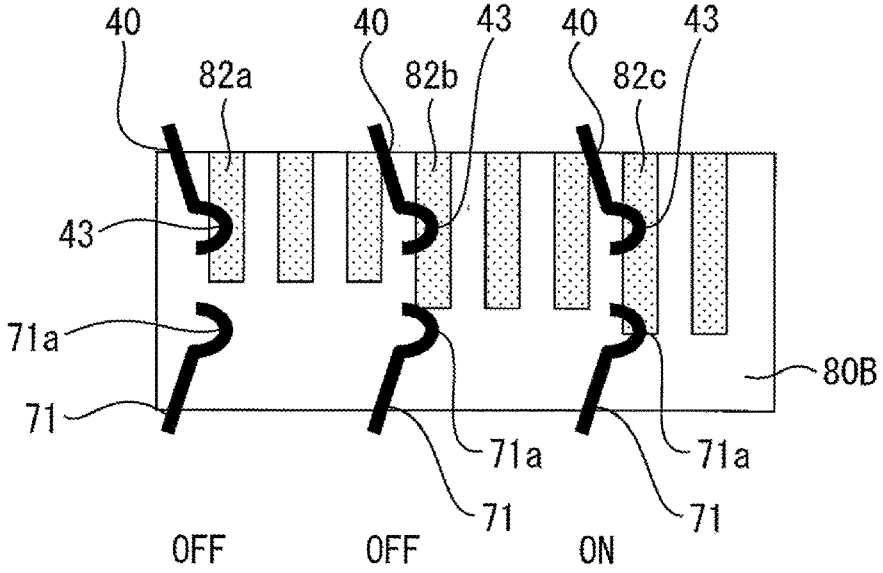

When the motor 64*a* moves the contact substrate 80B downward as shown in FIG. 18B, the curve 71*a* of the connection terminal 71 corresponding to the third slide contact 82*c* comes into contact with the third slide contact 82*c*. As a result, the connection terminal 40 and the connection terminal 71 corresponding to the third slide contact 82*c* are electrically connected with each other.

Figure 18C:
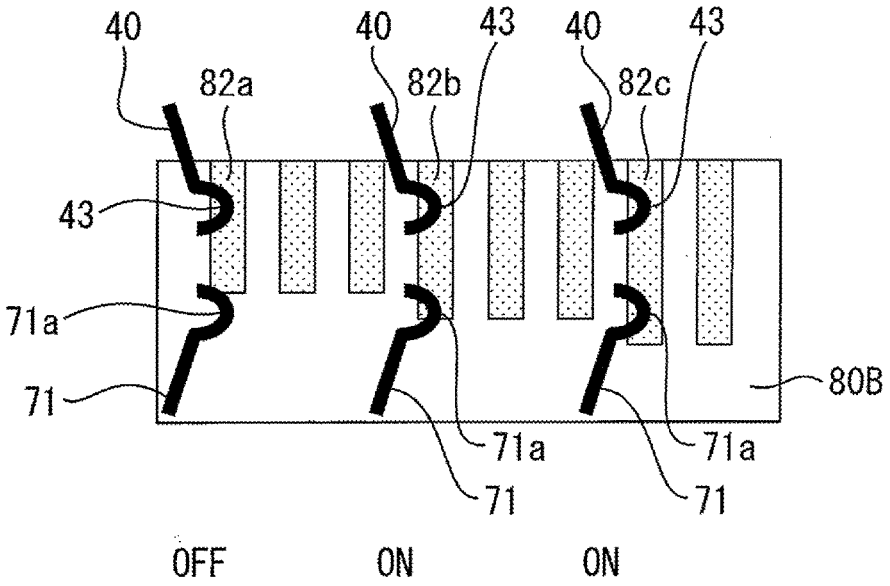

When the motor 64*a* moves the contact substrate 80B further downward as shown in FIG. 18C, the curve 71*a* of the connection terminal 71 corresponding to the second slide contact 82*b* comes into contact with the second slide contact 82*b*. As a result, the connection terminal 40 and the connection terminal 71 corresponding to the second slide contact 82*b* are electrically connected with each other.

Figure 18D:
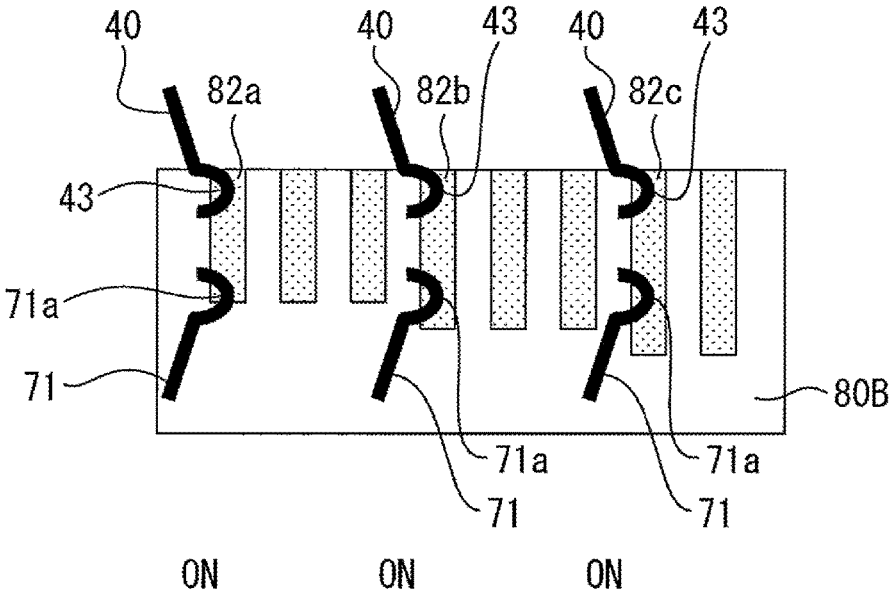

When the motor 64*a* moves the contact substrate 80B further downward as shown in FIG. 18D, the curve 71*a* of the connection terminal 71 corresponding to the first slide contact 82*a* comes into contact with the first slide contact 82*a*. As a result, the connection terminal 40 and the connection terminal 71 corresponding to the first slide contact 82*a* are electrically connected with each other. More specifically, all the connection terminals 40 are electrically connected with all the connection terminals 71.

As described above, the contact switching mechanism in the second contact on-off unit 60 according to the present modification includes the first slide contact 82*a*, the second slide contact 82*b*, and the third slide contact 82*c* having different vertical lengths. Thus, the connection terminals 40 and 71 corresponding to the first slide contact 82*a* are electrically connected when the contact substrate 80B is set at a first position. The connection terminals 40 and 71 corresponding to the second slide contact 82*b* are electrically connected when the contact substrate 80B is set at a second position different from the first position. The connection terminals 40 and 71 corresponding to the third slide contact 82*c* are electrically connected when the contact substrate 80B is set at a third position different from the first and second positions. This structure can switch the electrical connection/disconnection between the connection terminals 40 and 71 in a stepwise manner.

Although the contact substrate 80B in the present modification includes the three slide contacts 82 having different vertical lengths (the first slide contact 82*a*, the second slide contact 82*b*, and the third slide contact 82*c*), a contact switching mechanism according to one or more embodiments may have two slide contacts 82 with different vertical lengths or four or more slide contacts 82 with different vertical lengths.

Third Modification

A contact switching mechanism in the second contact on-off unit 60 according to another modification of a first embodiment will now be described with reference to FIGS. 19A and 19B.

Figure 19A:
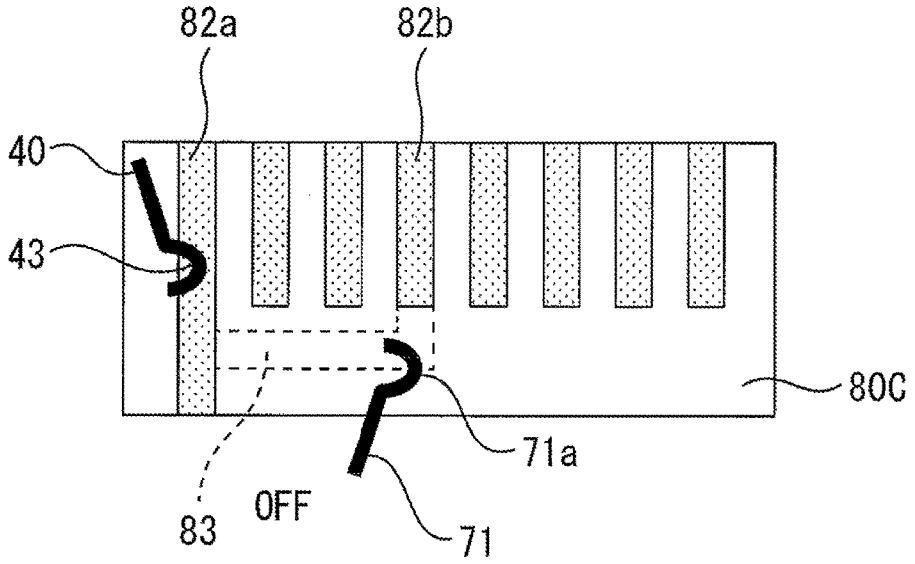
FIGS. 19A and 19B are diagrams illustrating the switching of the electrical connection/disconnection between connection terminals in a first contact on-off unit and connection terminals in second contact on-off units on a contact substrate according to still another modification of a first embodiment.
Figure 19B:
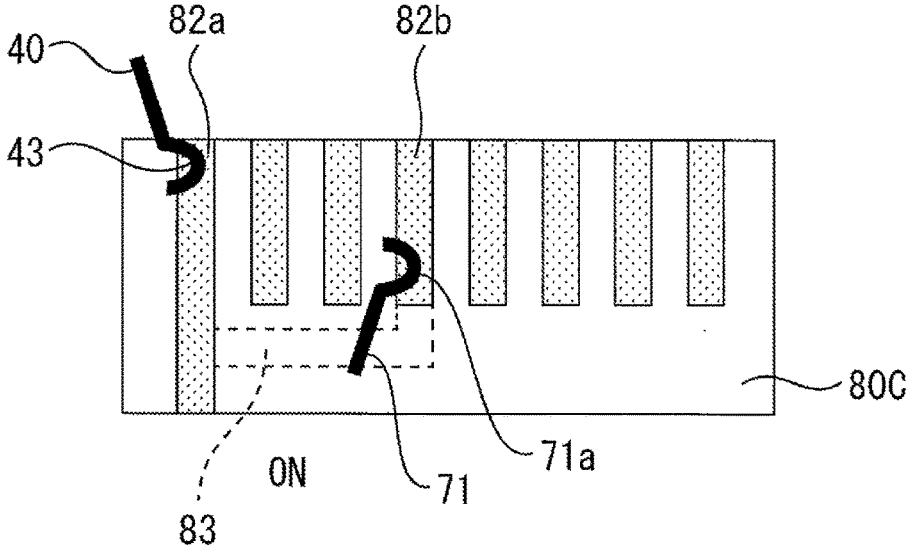

FIGS. 19A and 19B show the switching of the electrical connection/disconnection between the connection terminals 40 and 71 on a contact substrate 80C as a modification of the contact substrate 80 included in the second contact on-off unit 60 in a first embodiment.

As shown in FIGS. 19A and 19B, the contact substrate 80C in this modification includes a first slide contact 82*a* and a second slide contact 82*b*. The contact substrate 80C further includes a conductive part 83 in an area different from the areas in which the connection terminal 40 and the connection terminal 71 slide on the contact substrate 80C (sliding areas). The conductive part 83 electrically connects the first slide contact 82*a* and the second slide contact 82*b*. The conductive part 83 may be formed on a layer of a multilayer contact substrate 80C or may be formed on the surface of the contact substrate 80C opposite to the first slide contact 82*a* and the second slide contact 82*b*. In the present modification as shown in FIGS. 19A and 19B, the connection terminal 40 corresponding to the first slide contact 82*a* faces no connection terminal 71, whereas the connection terminal 71 corresponding to the second slide contact 82*b* faces no connection terminal 40.

In the contact switching mechanism in the second contact on-off unit 60 according to the present modification, when the contact substrate 80C is set at the upper position, the curve 71*a* of the connection terminal 71 corresponding to the second slide contact 82*b* is out of contact with the second slide contact 82*b* as shown in FIG. 19A. Thus, the connection terminal 40 and the connection terminal 71 shown in FIGS. 19A and 19B are electrically disconnected.

When the motor 64*a* moves the contact substrate 80C downward as shown in FIG. 19B, the curves 71*a* of the connection terminals 71 corresponding to the second slide contacts 82*b* come into contact with the second slide contacts 82*b*. The first slide contact 82*a* and the second slide contact 82*b* are electrically connected via the conductive part 83 as described above. Thus, the connection terminal 40 corresponding to the first slide contact 82*a* and the connection terminal 71 corresponding to the second slide contact 82*b* are also electrically connected with each other.

In the contact switching mechanism in the second contact on-off unit 60 according to the present modification, the first slide contact 82*a* corresponding to at least one connection terminal 40 and the second slide contact 82*b* corresponding to at least one connection terminal 71 to be electrically connected to or disconnected from the connection terminal 40 are not on a straight line parallel to the moving direction of the contact substrate 80C (or the vertical direction) (in other words, not collinear). More specifically, the connection terminal 40 and the connection terminal 71 each have a different slide contact for electrically connecting the connection terminal 40 and the connection terminal 71 in FIGS. 19A and 19B. The first slide contact 82*a* and the second slide contact 82*b* are electrically connected via the conductive part 83 in an area different from the sliding areas.

This contact switching mechanism in the second contact on-off unit 60 according to the present modification allows electrical connection between the first connection terminal set including the multiple connection terminals 40 and the second connection terminal set including the multiple connection terminals 71, and switches the electrical connection/disconnection between a connection terminal 40 and a connection terminal 71 not facing each other.

Fourth Modification

A contact switching mechanism in the second contact on-off unit 60 according to another modification of a first embodiment will now be described with reference to FIGS. 20A and 20B.

Figure 20A:
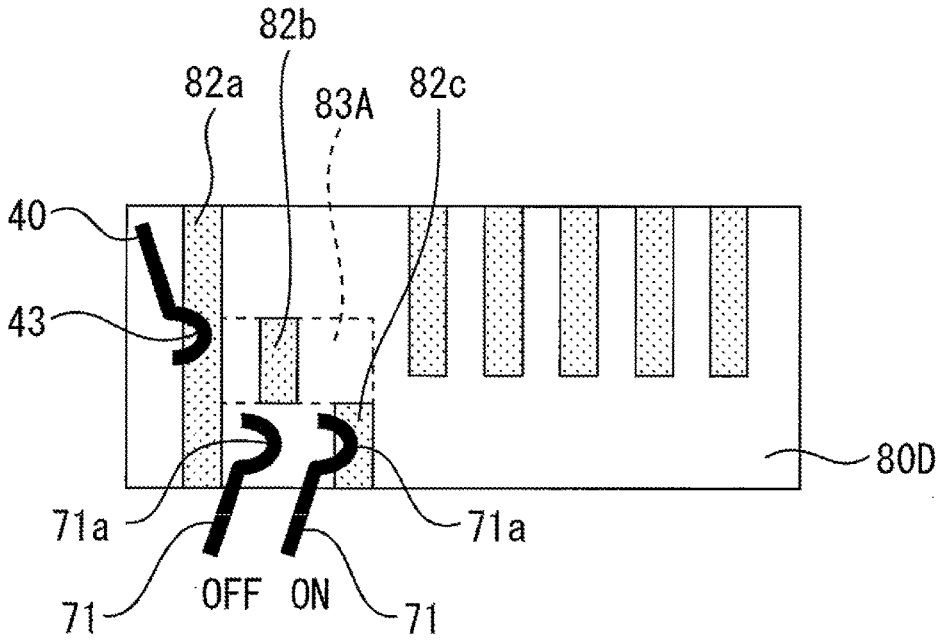
FIGS. 20A and 20B are diagrams illustrating the switching of the electrical connection/disconnection between connection terminals in a first contact on-off unit and connection terminals in second contact on-off units on a contact substrate according to still another modification of a first embodiment.
Figure 20B:
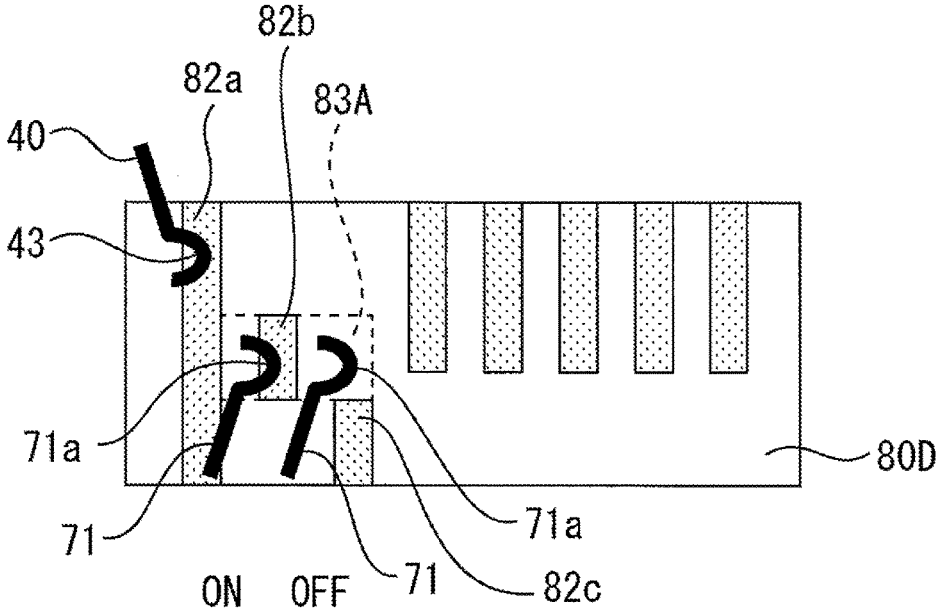

FIGS. 20A and 20B show the switching of the electrical connection/disconnection between the connection terminals 40 and 71 on a contact substrate 80D as a modification of the contact substrate 80 included in the second contact on-off unit 60 in a first embodiment.

As shown in FIGS. 20A and 20B, the contact substrate 80D in this modification has a first slide contact 82*a*, a second slide contact 82*b*, and a third slide contact 82*c*. The first slide contact 82*a* extends vertically across the contact substrate 80D. The second slide contact 82*b* is formed in a vertical middle area of the contact substrate 80D. The third slide contact 82*c* extends from the lower end of the second slide contact 82*b* to the bottom of the contact substrate 80D. Additionally, the contact substrate 80D has a conductive part 83A in an area different from the areas in which the connection terminal 40 and the connection terminal 71 slide on the contact substrate 80D (sliding areas). The conductive part 83A electrically connects the first slide contact 82*a*, the second slide contact 82*b*, and the third slide contact 82*c*. In the present modification, the connection terminal 40 corresponding to the first slide contact 82*a* faces no connection terminal 71, and the connection terminals 71 corresponding to the second slide contact 82*b* and the third slide contact 82*c* face no connection terminal 40 as shown in FIGS. 20A and 20B.

In the contact switching mechanism in the second contact on-off unit 60 according to the present modification, when the contact substrate 80D is set at the upper position, the third curve 43 of the connection terminal 40 corresponding to the first slide contact 82*a* is in contact with the first slide contact 82*a*, and the curve 71*a* of the connection terminal 71 corresponding to the third slide contact 82*c* is in contact with the third slide contact 82*c* as shown in FIG. 20A. Thus, the first slide contact 82*a* and the third slide contact 82*c* are electrically connected via the conductive part 83A as described above, and the connection terminal 40 corresponding to the first slide contact 82*a* and the connection terminal 71 corresponding to the third slide contact 82*c* are also electrically connected with each other. In the state shown in FIG. 20A, the curve 71*a* of the connection terminal 71 corresponding to the second slide contact 82*b* is out of contact with the second slide contact 82*b*. Thus, the connection terminal 40 corresponding to the first slide contact 82*a* and the connection terminal 71 corresponding to the second slide contact 82*b* are electrically disconnected.

When the motor 64*a* moves the contact substrate 80D downward as shown in FIG. 20B, the curve 71*a* of the connection terminal 71 corresponding to the third slide contact 82*c* comes out of contact with the third slide contact 82*c*, and the curve 71*a* of the connection terminal 71 corresponding to the second slide contact 82*b* comes into contact with the second slide contact 82*b*. As a result, the connection terminal 40 corresponding to the first slide contact 82*a* and the connection terminal 71 corresponding to the second slide contact 82*b* are electrically connected, whereas the connection terminal 40 corresponding to the first slide contact 82*a* and the connection terminal 71 corresponding to the third slide contact 82*c* are electrically disconnected.

In this manner, the contact switching mechanism in the second contact on-off unit 60 according to the present modification enables two connection terminals 71 to be electrically connected to or disconnected from one connection terminal 40. In other words, this mechanism includes a transfer contact.

Although the two connection terminals 71 in the present modification are electrically connected to or disconnected from one connection terminal 40, a contact switching mechanism according to one or more embodiments may electrically connect or disconnect three or more connection terminals 71 to or from one connection terminal 40.

Fifth Modification

A contact switching mechanism in the second contact on-off unit 60 according to another modification of a first embodiment will now be described with reference to FIGS. 21A and 21B.

Figure 21A:
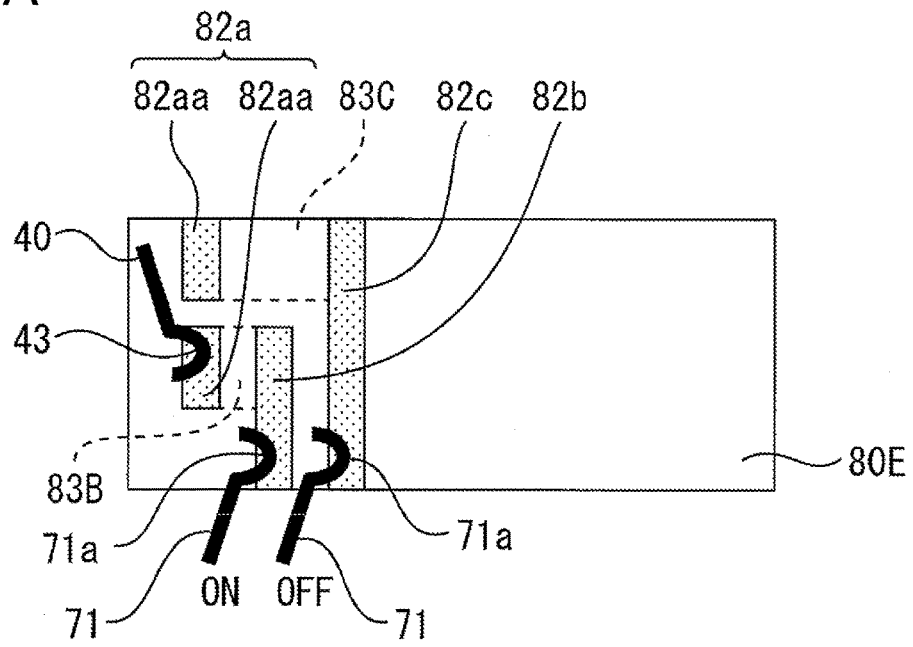
FIGS. 21A and 21B are diagrams illustrating the switching of the electrical connection/disconnection between connection terminals in a first contact on-off unit and connection terminals in second contact on-off units on a contact substrate according to still another modification of a first embodiment.
Figure 21B:
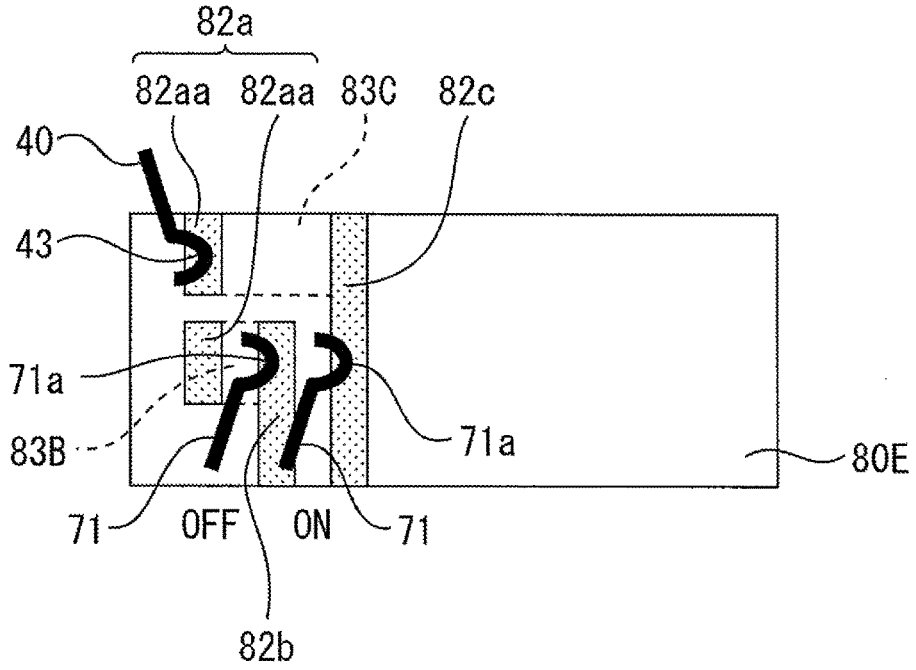

FIGS. 21A and 21B show the switching of the electrical connection/disconnection between the connection terminals 40 and 71 on a contact substrate 80E as a modification of the contact substrate 80 included in the second contact on-off unit 60 in a first embodiment.

As shown in FIGS. 21A and 21B, the contact substrate 80E in the present modification has a first slide contact 82*a*, a second slide contact 82*b*, and a third slide contact 82*c*. The first slide contact 82*a* includes two slide contacts separated into upper and lower parts (an upper slide contact 82*aa* and a lower slide contact 82*ab*). The second slide contact 82*b* extends vertically from the bottom of the contact substrate 80E to the upper end of the lower slide contact 82*ab*. The third slide contact 82*c* extends vertically from the bottom of the contact substrate 80E to the upper end of the upper slide contact 82*aa*.

Additionally, the contact substrate 80E has a conductive part 83B and a conductive part 83C in areas different from the areas in which the connection terminal 40 and the connection terminal 71 slide on the contact substrate 80E (sliding areas). The conductive part 83B electrically connects the lower slide contact 82*ab* of the first slide contact 82*a* and the second slide contact 82*b*. The conductive part 83C electrically connects the upper slide contact 82*aa* of the first slide contact 82*a* and the third slide contact 82*c*. In the present modification as shown in FIGS. 21A and 21B, the connection terminal 40 corresponding to the first slide contact 82*a* faces no connection terminal 71, whereas the connection terminal 71 corresponding to the second slide contact 82*b* faces no connection terminal 40.

In the contact switching mechanism in the second contact on-off unit 60 according to the present modification, when the contact substrate 80E is set at the upper position, the third curve 43 of the connection terminal 40 corresponding to the first slide contact 82*a* is in contact with the lower slide contact 82*ab*, and the curve 71*a* of the connection terminal 71 corresponding to the second slide contact 82*b* is in contact with the second slide contact 82*b* as shown in FIG. 21A. Thus, the connection terminal 40 corresponding to the first slide contact 82*a* and the connection terminal 71 corresponding to the second slide contact 82*b* are electrically connected.

When the motor 64*a* moves the contact substrate 80E downward as shown in FIG. 21B, the third curve 43 of the connection terminal 40 corresponding to the first slide contact 82*a* comes out of contact with the lower slide contact 82*ab* and into contact with the upper slide contact 82*aa*. The curve 71*a* of the connection terminal 71 corresponding to the third slide contact 82*c* is in contact with the third slide contact 82*c*. As a result, the connection terminal 40 corresponding to the first slide contact 82*a* is electrically disconnected from the connection terminal 71 corresponding to the second slide contact 82*b*, and the connection terminal 40 corresponding to the first slide contact 82*a* is electrically connected to the connection terminal 71 corresponding to the third slide contact 82*c*.

In this manner, the contact switching mechanism in the second contact on-off unit 60 according to the present modification enables two connection terminals 71 to be electrically connected to or disconnected from one connection terminal 40. In other words, this mechanism includes a transfer contact.

The contact switching mechanisms in a first embodiment and each modification are examples of the contact switching mechanism according to one or more embodiments. The contact switching mechanism according to one or more embodiments may be any mechanism that electrically connects or disconnects connection terminals by moving a contact substrate. In that contact switching mechanism, simply changing the slide contacts (wiring pattern) formed on the contact substrate can change the connection terminals to be connected to them (the switching can be changed). The contact substrate may also include a combination of the formation patterns of the slide contacts described in one or more embodiments and modifications.

Second Embodiment

Other embodiments will now be described with reference to FIGS. 22 to 26. For ease of explanation, the components having the same functions as the components described in a first embodiment are given the same reference numerals as those components, and will not be described.

Figure 22:
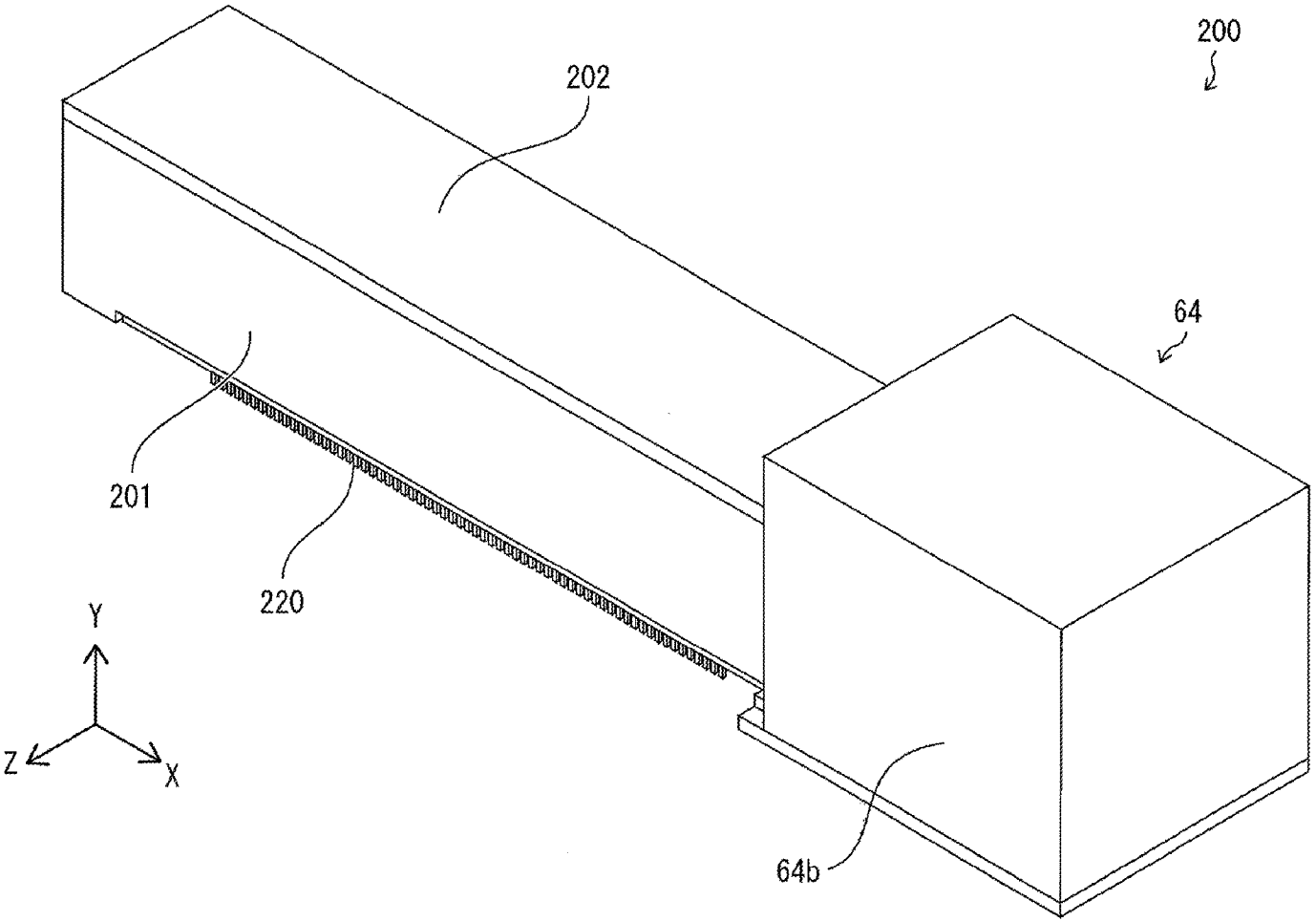
FIG. 22 is a perspective view illustrating a switch according to a second embodiment.
Figure 23:
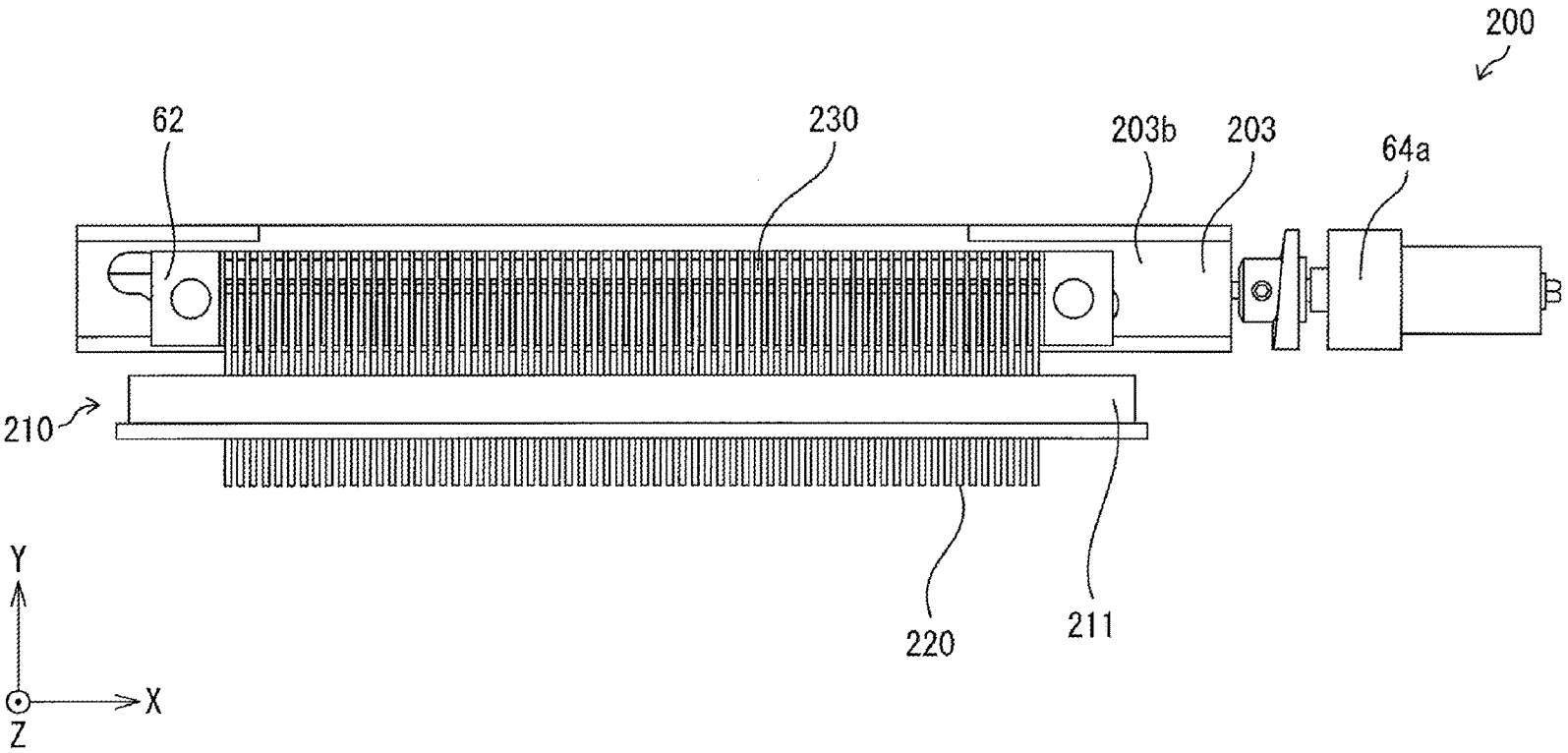
FIG. 23 is a side view illustrating a switch.
Figure 24:
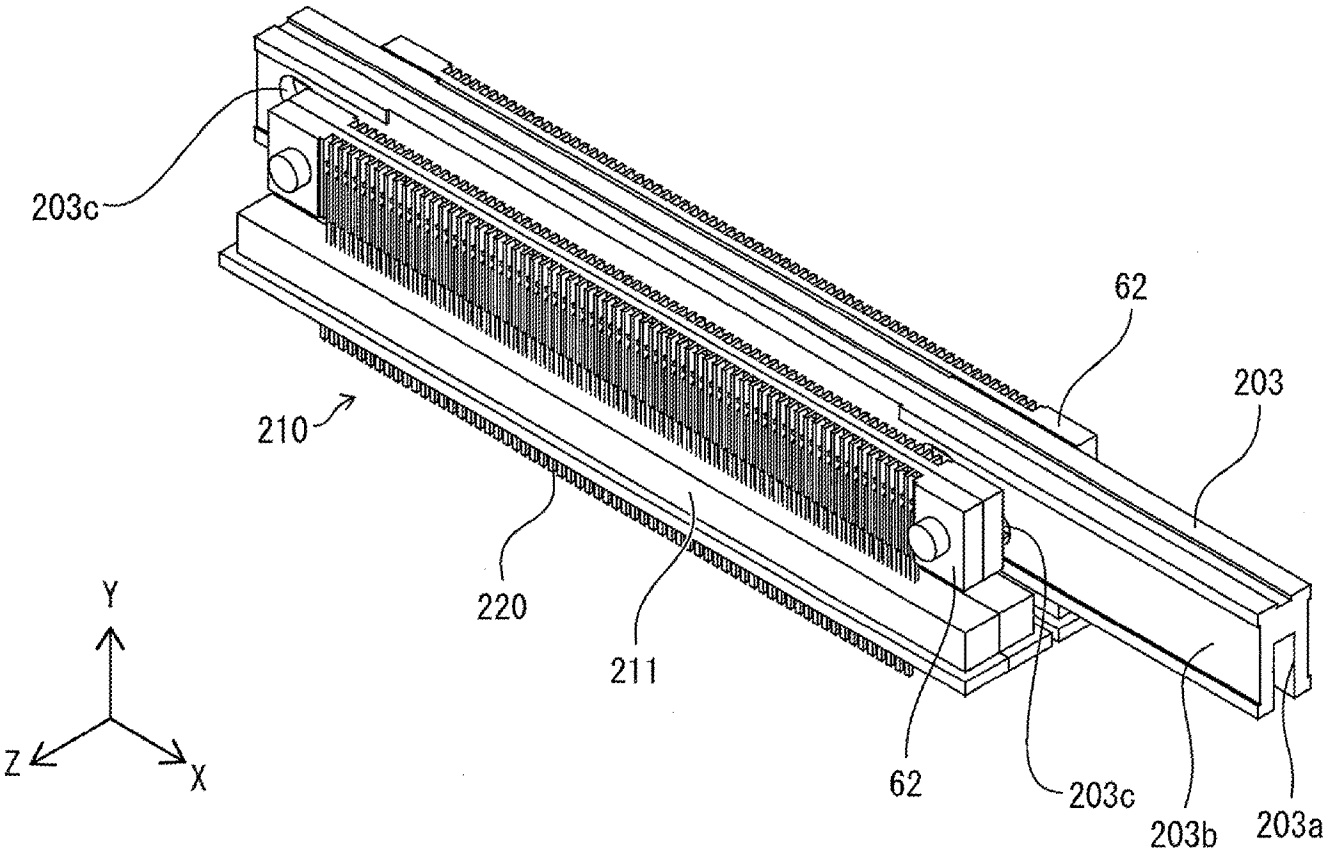
FIG. 24 is a perspective view illustrating terminal units, substrate holders, and a guide rail included in a switch.

FIG. 22 is a perspective view of a switch 200 according to an embodiment. FIG. 23 is a side view of the switch 200. In FIG. 23, a housing 201, a lid 202, and a motor box 64*b* (described later) are not shown. FIG. 24 is a perspective view of terminal units 210, substrate holders 62, and a guide rail 203.

As shown in FIGS. 22 to 24, the switch 200 includes the housing 201, the lid 202, the two terminal units 210, two contact substrates (substrates) 230, the two substrate holders 62, the guide rail 203, and the motor unit 64.

The housing 201 contains each component of the switch 200. The top of the housing 201 is closed by the lid 202. The bottom of the housing 201 is open.

The terminal units 210 each include multiple connection terminals 220 (first connection terminals and second connection terminals) and a holding member 211. The structure of the terminal unit 210 is the same as the terminal unit 70 in a first embodiment, and will not be described in detail.

The guide rail 203 is placed between the two right and left substrate holders 62. As shown in FIG. 24, the guide rail 203 has a cuboid shape extending in the front-and-rear direction, and has a hollow 203*a* that is open downward. The guide rail 203 has right and left sides 203*b* each having openings 203*c*. The openings 203*c* have the same shape as the openings 63*a* in a first embodiment. The openings 203*c* receive the protrusions 62*b* on the substrate holders 62.

As in a first embodiment, the motor 64*a* drives (actuator driving) the guide rails 203 to move in the front-and-rear direction in an embodiment. As the guide rail 203 moves, each protrusion 62*b* on the substrate holder 62 receives a force applied from the openings 203*c* in the guide rail 203.

This moves the substrate holder 62 vertically. As the substrate holder 62 move, the contact substrate 230 moves vertically.

Figure 25:
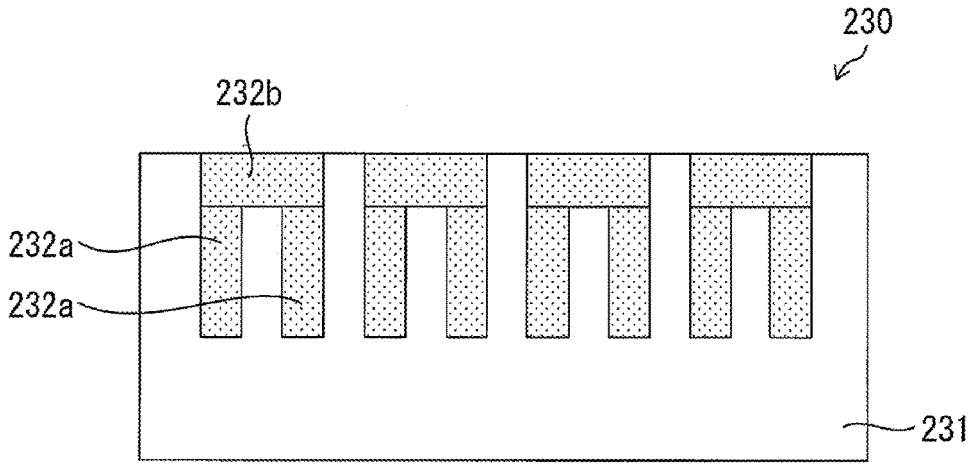
FIG. 25 is a plan view illustrating a contact substrate included in a switch.

FIG. 25 is a plan view of a contact substrate 230. FIG. 25 shows a part of the contact substrate 230 (the same applied to FIG. 26).

The contact substrate 230 is used to switch the electrical connection/disconnection between the multiple connection terminals 220 in the terminal unit 210. The contact substrate 230 is held by the substrate holder 62. As shown in FIG. 25, the contact substrate 230 has, on an insulating part 231, multiple first slide contacts 232*a* corresponding to the connection terminals 220, and multiple second slide contacts 232*b* each connecting two adjacent first slide contacts 232*a*.

Figure 26A:
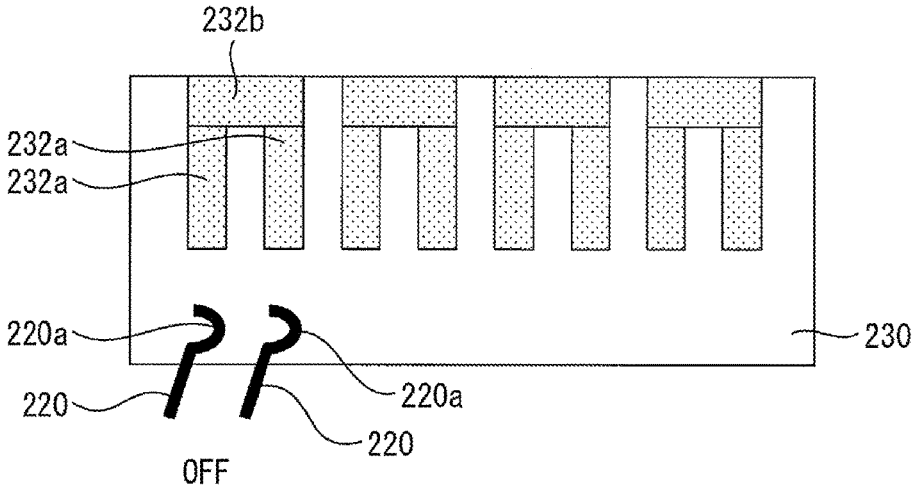
FIGS. 26A and 26B are diagrams illustrating the switching of the electrical connection/disconnection between connection terminals in a switch.
Figure 26B:
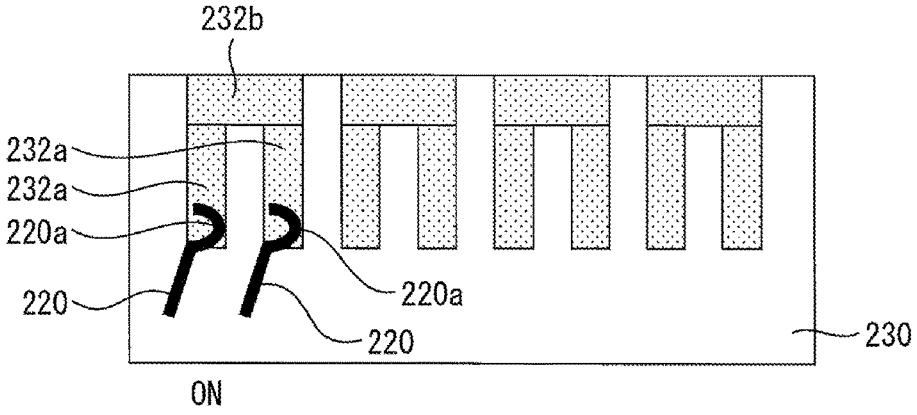

FIGS. 26A and 26B show the switching of the electrical connection/disconnection between the connection terminals 220 in the switch 200. For simplicity, FIGS. 26A and 26B show only two connection terminals 220.

As shown in FIG. 26A, when the contact substrate 230 is set at the upper position in the contact switching mechanism in the switch 200, curves 220*a* of the connection terminals 220 are out of contact with the first slide contacts 232*a*, and the connection terminals 220 are electrically disconnected.

When the motor 64*a* moves the contact substrate 230 downward as shown in FIG. 26B, the curves 220*a* of the connection terminals 220 come into contact with the first slide contacts 232*a*. As a result, the two adjacent connection terminals 220 are electrically connected, with the two adjacent first slide contacts 232*a* connected by the second slide contact 232*b* as described above.

In the switch 200 (switching mechanism) in an embodiment, the motor 64*a* moves the contact substrate 230 to allow the connection terminals 220 to slide on the contact substrate 230 to change the contact state between the first slide contacts 232*a* and the connection terminals 220. This switches the electrical connection/disconnection between the connection terminals 220.

This structure moves the contact substrate 230 to switch the electrical connection/disconnection between the connection terminals 220. The connection terminals 220 are connected to a device controlled by the switch 200, and thus typically difficult to move. The contact switching mechanism switches the electrical connection/disconnection by moving the contact substrate 230 without moving the connection terminals 220. Thus, the simple structure without, for example, additional moving contacts, can switch the electrical connection/disconnection between the connection terminals 220. In the switch 200, the connection terminals 220 for each set of slide contacts (more specifically, each set of two first slide contacts 232*a* and one second slide contact 232*b*) include left and right connection terminals 220 shown in FIGS. 26A and 26B. The left connection terminals 220 corresponds a first connection terminal set, whereas the right connection terminals 220 corresponds to a second connection terminal set. In this case, the switch 200 (switching mechanism) according to an embodiment switches the electrical connection/disconnection between the first connection terminal set including multiple connection terminals 220 and the second connection terminal set including multiple connection terminals 220.

Sixth Modification

A contact switching mechanism according to a modification of a second embodiment will now be described with reference to FIGS. 27A and 27B.

Figure 27A:
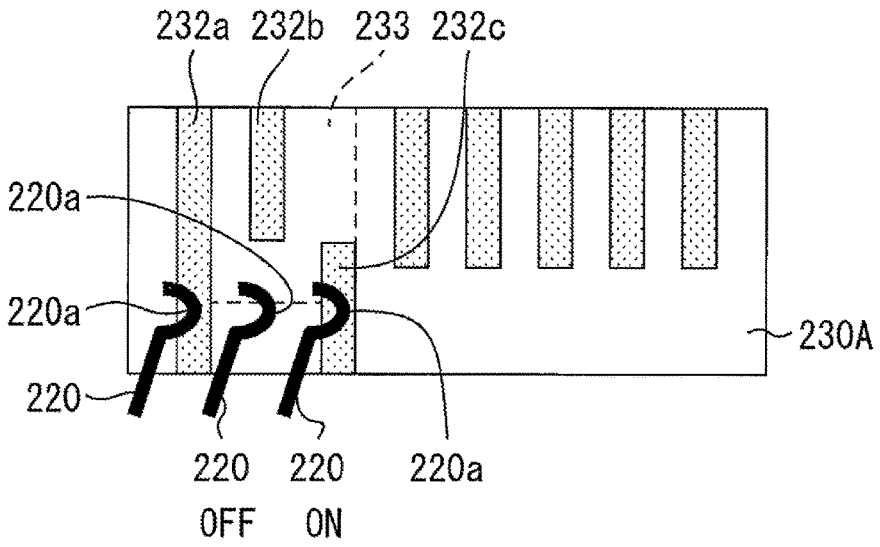
FIGS. 27A and 27B are diagrams illustrating the switching of the electrical connection/disconnection between connection terminals on a contact substrate according to a modification of a second embodiment.
Figure 27B:
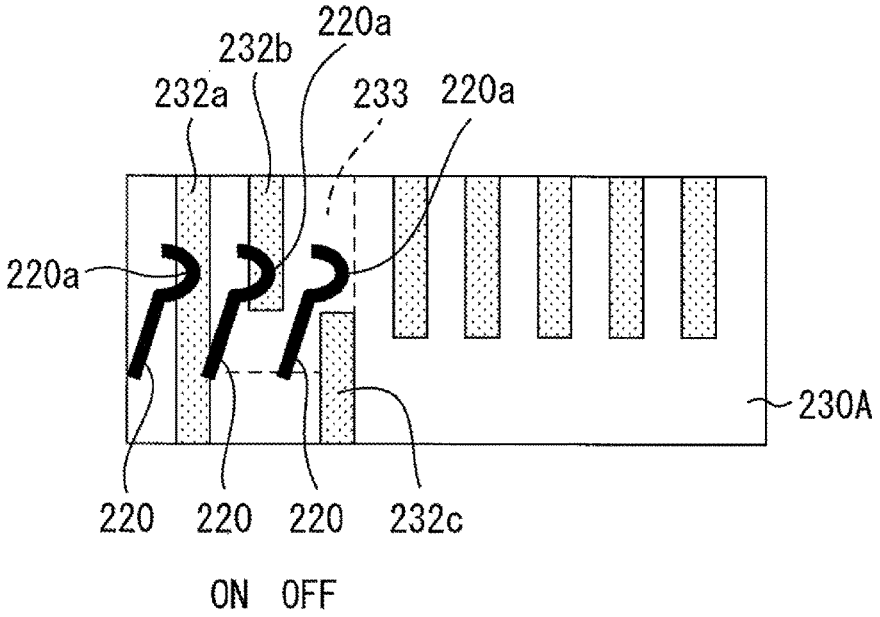

FIGS. 27A and 27B show the switching of the electrical connection/disconnection between connection terminals 220 on a contact substrate 230A as a modification of the contact substrate 230 in a second embodiment.

As shown in FIGS. 27A and 27B, the contact substrate 230A in the present modification has a first contact receiving segment 232*a*, a second contact receiving segment 232*b*, and a third contact receiving segment 232*c*. The first slide contact 232*a* extends vertically across the contact substrate 230A. The second slide contact 232*b* extends from the top of the contact substrate 230A to the middle. The third slide contact 232*c* extends from the lower end of the second slide contact 232*b* to the bottom of the contact substrate 230A. Additionally, the contact substrate 230A has a conductive part 233 in an area different from the areas in which the connection terminals 220 slide on the contact substrate 230A (sliding areas). The conductive part 233 electrically connects the first slide contact 232*a* to the second slide contact 232*b* and the third slide contact 232*c*.

In the contact switching mechanism in the present modification, when the contact substrate 230A is set at the upper position, the curve 220*a* of the connection terminal 220 corresponding to the first slide contact 232*a* is in contact with the first slide contact 232*a*, and the curve 220*a* of the connection terminal 220 corresponding to the third slide contact 232*c* is in contact with the third slide contact 232*c* as shown in FIG. 27A. Thus, the connection terminal 220 corresponding to the first slide contact 232*a* and the connection terminal 220 corresponding to the third slide contact 232*c* are electrically connected, with the first slide contact 232*a* and the third slide contact 232*c* electrically connected by the conductive part 233 as described above. In the state shown in FIG. 27A, the curve 220*a* of the connection terminal 220 corresponding to the second slide contact 232*b* is out of contact with the second slide contact 232*b*. Thus, the connection terminal 220 corresponding to the first slide contact 232*a* and the connection terminal 220 corresponding to the second slide contact 232*b* are electrically disconnected.

When the motor 64*a* moves the contact substrate 230A downward as shown in FIG. 27B, the curve 220*a* of the connection terminal 220 corresponding to the third slide contact 232*c* comes out of contact with the third slide contact 232*c*, and the curve 220*a* of the connection terminal 220 corresponding to the second slide contact 232*b* comes into contact with the second slide contact 232*b*. As a result, the connection terminal 220 corresponding to the first slide contact 232*a* and the connection terminal 220 corresponding to the second slide contact 232*b* are electrically connected, and the connection terminal 220 corresponding to the first slide contact 232*a* and the connection terminal 220 corresponding to the third slide contact 232*c* are electrically disconnected.

In this manner, the contact switching mechanism according to the present modification enables two connection terminals 220 to be electrically connected to or disconnected from one connection terminal 220. In other words, this mechanism includes a transfer contact.

In the present modification, two connection terminals 220 are electrically connected to or disconnected from one connection terminal 220. However, the contact switching mechanism according to one or more embodiments is not limited to this example. A contact switching mechanism according to one aspect may electrically connect or disconnect three or more connection terminals 220 to or from one connection terminal 220.

The switches and the contact switching mechanisms in a second embodiment and its modification are mere examples. The contact switching mechanism according to one or more embodiments may be any mechanism that electrically connects or disconnects connection terminals by moving a contact substrate. In this contact switching mechanism, simply changing the slide contacts (wiring pattern) formed on the contact substrate can change the connection terminals to be connected to them (the switching can be changed). The contact substrate may also include a combination of the formation patterns of the slide contacts described in the embodiments and the modifications.

The embodiments disclosed herein should not be construed to be restrictive, but may be modified within the spirit and scope of the claimed invention. The technical features disclosed in different embodiments may be combined in other embodiments within the technical scope of the invention.

REFERENCE SIGNS LIST

10 connector unit (connector)
40 connection terminal (first connection terminal)
64*a* motor (substrate drive)
71 connection terminal (second connection terminal)
80, 80A to 80E, 230, 230A contact substrate (substrate)
82 slide contact
82*a*, 232*a* first slide contact (slide contact)
82*b* second slide contact (slide contact)
82*c* third slide contact (slide contact)
100 probe connector (connection target)
112 connection terminal (target terminal)
220 connection terminal (first connection terminal, second connection terminal)

The invention claimed is:

1. A contact switching mechanism, comprising:
a plurality of connection terminal sets;
an insulating substrate comprising a conductive slide contact; and
a substrate drive comprising a motor moving the substrate,
wherein the substrate drive moves the substrate to cause the connection terminal sets to slide on the substrate to change a contact state between the slide contact and the connection terminal sets and to switch electrical connection/disconnection between the connection terminal sets.

2. The contact switching mechanism according to claim 1, wherein
the plurality of connection terminal sets comprises at least one first connection terminal and at least one second connection terminal, and
the substrate drive moves the substrate to switch electrical connection/disconnection between the at least one first connection terminal and the at least one second connection terminal.

3. The contact switching mechanism according to claim 2, wherein
the slide contact is located on a straight line comprising a point of contact between the at least one first connection terminal and the substrate, and a point of contact between the at least one second connection terminal facing the at least one first connection terminal and the substrate, and
the substrate drive moves the substrate in a direction parallel to the straight line to switch electrical connection/disconnection between the at least one first connection terminal and the at least one second connection terminal.

4. The contact switching mechanism according to claim 3, wherein
the slide contact comprises a first slide contact and a second slide contact having different lengths along the straight line, and
the at least one first connection terminal and the at least one second connection terminal corresponding to the first slide contact are electrically connected to each other when the substrate is at a first position, and the at least one first connection terminal and the at least one second connection terminal corresponding to the second slide contact are electrically connected to each other when the substrate is at a second position different from the first position.

5. The contact switching mechanism according to claim 4, wherein
the first connection terminal and the second connection terminal corresponding to the first slide contact are electrically connected to each other irrespective of the position of the substrate.

6. The contact switching mechanism according to claim 2, further comprising:
a first slide contact corresponding to the at least one first connection terminal, and a second slide contact corresponding to the at least one second connection terminal to be electrically connected to or disconnected from the at least one first connection terminal are not located on a straight line parallel to a moving direction of the substrate,
wherein the first slide contact and the second slide contact are electrically connected to each other in an area different from sliding areas of the first connection terminal and the second connection terminal.

7. A connector for electrically connecting to a connection target, the connector comprising:
the contact switching mechanism according to claim 1, wherein
the plurality of connection terminal sets comprise a first connection terminal set comprising a plurality of first connection terminals and a second connection terminal set comprising a plurality of second connection terminals,
the first connection terminal set corresponds to a plurality of target terminals included in the connection target, and
the substrate drive moves the substrate to switch electrical connection/disconnection between the first connection terminal set and the second connection terminal set.

8. A connector for electrically connecting to a connection target, the connector comprising:
the contact switching mechanism according to claim 2, wherein
the plurality of connection terminal sets comprise a first connection terminal set comprising a plurality of first connection terminals and a second connection terminal set comprising a plurality of second connection terminals,
the first connection terminal set corresponds to a plurality of target terminals included in the connection target, and
the substrate drive moves the substrate to switch electrical connection/disconnection between the first connection terminal set and the second connection terminal set.

9. A connector for electrically connecting to a connection target, the connector comprising:
the contact switching mechanism according to claim 3, wherein the plurality of connection terminal sets comprise a first connection terminal set comprising a plurality of first connection terminals and a second connection terminal set comprising a plurality of second connection terminals, the first connection terminal set corresponds to a plurality of target terminals included in the connection target, and the substrate drive moves the substrate to switch electrical connection/disconnection between the first connection terminal set and the second connection terminal set.

10. A connector for electrically connecting to a connection target, the connector comprising:

the contact switching mechanism according to claim 4, wherein the plurality of connection terminal sets comprise a first connection terminal set comprising a plurality of first connection terminals and a second connection terminal set comprising a plurality of second connection terminals, the first connection terminal set corresponds to a plurality of target terminals included in the connection target, and the substrate drive moves the substrate to switch electrical connection/disconnection between the first connection terminal set and the second connection terminal set.

11. A connector for electrically connecting to a connection target, the connector comprising:

the contact switching mechanism according to claim 5, wherein the plurality of connection terminal sets comprise a first connection terminal set comprising a plurality of first connection terminals and a second connection terminal set comprising a plurality of second connection terminals, the first connection terminal set corresponds to a plurality of target terminals included in the connection target, and the substrate drive moves the substrate to switch electrical connection/disconnection between the first connection terminal set and the second connection terminal set.

12. A connector for electrically connecting to a connection target, the connector comprising:

the contact switching mechanism according to claim 6, wherein the plurality of connection terminal sets comprise a first connection terminal set comprising a plurality of first connection terminals and a second connection terminal set comprising a plurality of second connection terminals, the first connection terminal set corresponds to a plurality of target terminals included in the connection target, and the substrate drive moves the substrate to switch electrical connection/disconnection between the first connection terminal set and the second connection terminal set.

* * * * *